US007728501B2

(12) United States Patent
Hori

(10) Patent No.: US 7,728,501 B2
(45) Date of Patent: Jun. 1, 2010

(54) IMAGE DISPLAY APPARATUS AND VIDEO SIGNAL RECEIVING AND DISPLAY APPARATUS

(75) Inventor: Atsushi Hori, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 807 days.

(21) Appl. No.: 11/623,523

(22) Filed: Jan. 16, 2007

(65) Prior Publication Data

US 2007/0164674 A1 Jul. 19, 2007

(30) Foreign Application Priority Data

Jan. 17, 2006 (JP) ..... 2006-008812

(51) Int. Cl.
*H01J 1/62* (2006.01)

(52) U.S. Cl. ..... 313/492; 313/512; 313/506; 313/495; 313/497

(58) Field of Classification Search ..... 313/495, 313/496, 497, 500, 422, 506, 512, 492; 315/169.3, 315/169.4
See application file for complete search history.

(56) References Cited

U.S. PATENT DOCUMENTS 6,803,717 B2 10/2004 Ohnishi ..... 313/495
6,998,769 B2 2/2006 Ohnishi ..... 313/495
7,247,981 B2 * 7/2007 Yamazaki ..... 313/497
7,391,149 B2 * 6/2008 Yamazaki ..... 313/495

FOREIGN PATENT DOCUMENTS

JP 2002-237268 8/2002
JP 2002-367540 12/2002

* cited by examiner

*Primary Examiner*—Tuyet Vo
(74) *Attorney, Agent, or Firm*—Fitzpatrick, Cella, Harper & Scinto

(57) ABSTRACT

An image display apparatus includes an envelope, first to third electroconductive members disposed in the envelope, a plate-like spacer disposed between the first and third members and between the second and third members, and a circuit for supplying a potential to the first member and supplying a potential lower than that of the first member to the second and third members. When a sheet resistance between a first region of the spacer to which the potential is supplied from the first member and a second region of the spacer to which the potential is supplied from the second member is defined as ρf [Ω/□] and a sheet resistance between a third region of the spacer to which the potential is supplied from the third member and a region located between the first and second regions is defined as ρr [Ω/□], a condition $1/100<\rho r/\rho f\leqq 40$ is satisfied.

22 Claims, 13 Drawing Sheets

IMAGE DISPLAY APPARATUS AND VIDEO SIGNAL RECEIVING AND DISPLAY APPARATUS

BACKGROUND OF THE INVENTION

1. Field of the Invention

The present invention relates to an image display apparatus and a video signal receiving and display apparatus that are used for television receivers and computer display apparatuses.

2. Description of the Related Art

Field emission display apparatuses, which are one type of flat panel display apparatus, are known.

In field emission display apparatuses, electrons emitted from an electron emitting device to an anode need to be accelerated by applying a high voltage to between the electron emitting device and the anode including a light emitting material, such as a fluorescent member. Accordingly, a high electric field intensity must be maintained between a faceplate having the anode mounted thereon and a rear plate having the electron emitting device mounted thereon.

Additionally, a spacer is disposed between the rear plate and the faceplate to maintain a certain distance therebetween. However, the electric field tends to concentrate at a corner of the spacer in the longitudinal direction and the structure such as a securing member for securing the spacer due to the geometric effect. To reduce the electric field concentration at the corner of the spacer and that structure, an electrode having a potential that is lower than that of the anode may be disposed on the faceplate at a position separated from the anode.

To reduce electric discharge occurring around the connection point between the electrode having the potential that is lower than that of the anode and the spacer, Japanese Patent Laid-Open No. 2002-237268 describes a technology in which an electrode is provided on the surface of the spacer so as to be connected to the electrode having the potential that is lower than that of the anode.

In addition, to prevent the occurrence of non-uniform distribution of the electric potential of the spacer, Japanese Patent Laid-Open No. 2002-367540 describes a technology in which the surface resistance value of a region of the spacer between the anode and the electrode having the potential that is lower than that of the anode is increased to a value higher than that of the region of the spacer corresponding to the anode.

SUMMARY OF THE INVENTION

However, when the electrode having the potential that is lower than that of the anode is provided, electric discharge sometimes occurs between the electrode having the potential that is lower than that of the anode and the anode.

In addition, to reduce the size of the image display apparatus, it is desirable that a non-image display region of the image display apparatus, which is a region other than an image display unit (typically a region where the anode is disposed), is reduced. Accordingly, it is desirable that the distance between the electrode having the potential that is lower than that of the anode and being disposed in the non-image display region and the anode is decreased. Furthermore, it is desirable that the displayed image has high contrast and high resolution. One method of increasing the contrast of the displayed image is to increase the voltage applied to between the electron emitting device and the anode. One method of increasing the resolution of the displayed image is to decrease the distance between the electron emitting device and the anode.

However, in the method described in Japanese Patent Laid-Open No. 2002-237268 in which an electrode is provided on the surface of the spacer so as to be connected to the electrode having the potential that is lower than that of the anode, the electric field intensity around the electrode connected to the electrode having the potential that is lower than that of the anode becomes high. Therefore, electric discharge may occur.

Similarly, in the structure described in Japanese Patent Laid-Open No. 2002-367540, the electric field concentrates in an area around the connection point between the spacer and the electrode having the electric potential that is lower than that of the anode. Therefore, the electric discharge from the area around the connection point may occur.

Accordingly, to reduce the electric discharge, it is desirable that the electric field concentration on the electrode having the potential that is lower than that of the anode is further reduced.

Accordingly, the present invention provides an image display apparatus for further reducing the electric field concentration on the electrode having the potential that is lower than that of the anode so as to reduce the occurrence of electric discharge.

According to an embodiment of the present invention, an image display apparatus includes (a) an envelope, (b) a first electroconductive member, a second electroconductive member, and a third electroconductive member disposed in the envelope, (c) a plate-like spacer disposed between the first electroconductive member and the third electroconductive member and between the second electroconductive member and the third electroconductive member, and (d) a circuit for supplying an electric potential to the first electroconductive member and supplying an electric potential that is lower than the electric potential of the first electroconductive member to the second electroconductive member and the third electroconductive member. When a sheet resistance between a first region of the plate-like spacer to which the electric potential is supplied from the first electroconductive member and a second region of the plate-like spacer to which the electric potential is supplied from the second electroconductive member is defined as $\rho f$ [Ω/□], and a sheet resistance between a third region of the plate-like spacer to which the electric potential is supplied from the third electroconductive member and a region located between the first region and the second region is defined as $\rho r$ [Ω/□], a condition $1/100<\rho r/\rho f\leqq 40$ is satisfied.

According to the present invention, the image display apparatus can be provided that reduces the electric field concentration on the electrode having the potential that is lower than that of the anode so as to reduce the occurrence of electric discharge.

Further features of the present invention will become apparent from the following description of exemplary embodiments with reference to the attached drawings.

DESCRIPTION OF THE EMBODIMENTS

Exemplary embodiments of the present invention are described in detail with reference to the accompanying drawings.

First Exemplary Embodiment

An exemplary structure of an image display apparatus according to a first exemplary embodiment of the present invention is described below with reference to FIGS. 1 and 2.

Figure 1:
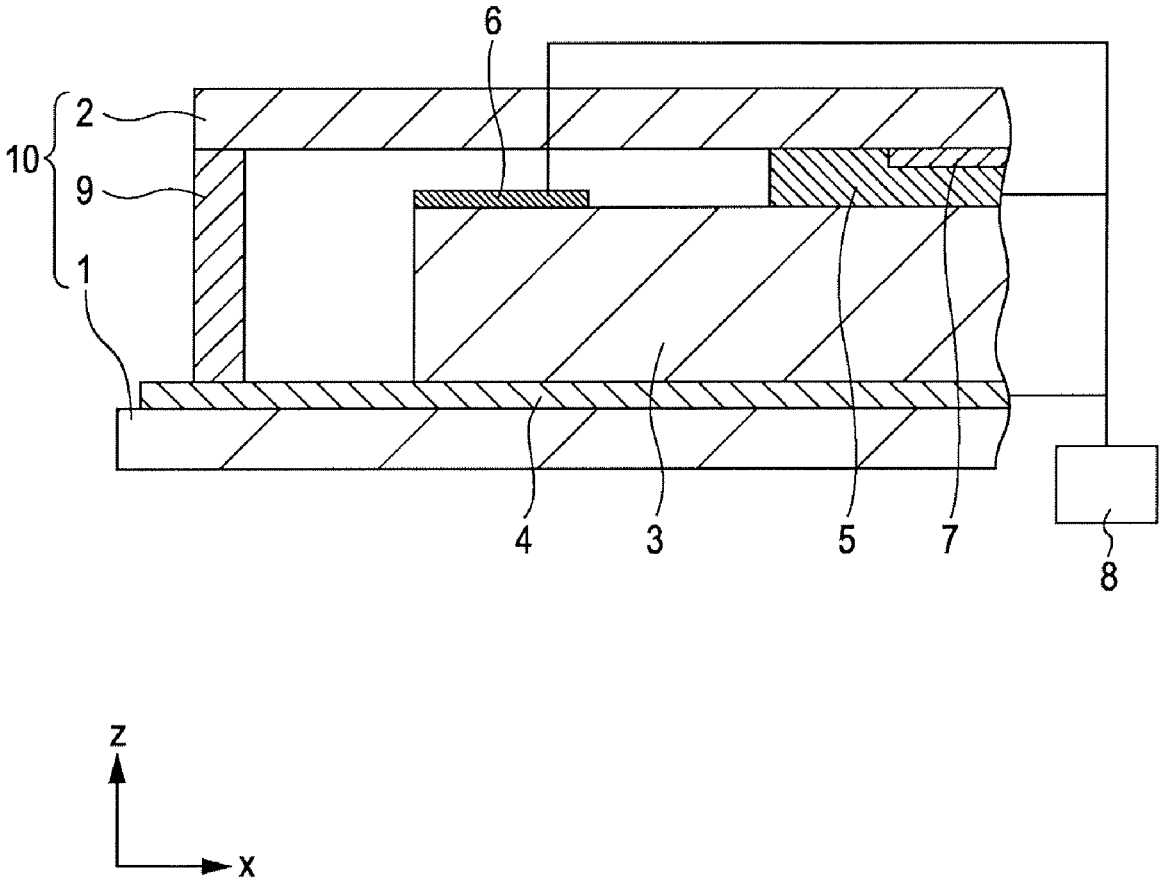
FIG. 1 is a schematic illustration of an exemplary structure of an image display apparatus according to an embodiment of the present invention.

FIG. 1 is a schematic illustration of a cross section around an end of an anode of the image display apparatus according to the first exemplary embodiment. As shown in FIG. 1, the image display apparatus includes a rear plate 1, a faceplate 2, a plate-like spacer 3, an x-direction wiring (a third electroconductive member) 4, an anode (a first electroconductive member) 5, a first potential regulating electrode (a second electroconductive member) 6, a fluorescent member 7 (a light emitting element), a circuit 8, a side wall 9, and an envelope 10. The envelope 10 includes the rear plate 1, the faceplate 2, and the side wall 9. The term "x direction" refers to a direction in which the x-direction wiring 4 extends. Alternatively, the term "x direction" refers to a direction in which the anode 5 faces the first potential regulating electrode 6. The term "z direction" refers to a direction that is substantially perpendicular to the surface of the faceplate 2 adjacent to the rear plate 1 or to the surface of the rear plate 1 adjacent to the faceplate 2. Alternatively, the term "z direction" refers to a direction in which the faceplate 2 faces the rear plate 1. The x direction is perpendicular to the z direction.

The x-direction wiring 4 is disposed on the surface of the rear plate 1 adjacent to the faceplate 2. The anode 5 is disposed on the surface of the faceplate 2 adjacent to the rear plate 1. The first potential regulating electrode 6 is disposed on the surface of the plate-like spacer 3 in an area facing the faceplate 2. The plate-like spacer 3 is disposed between the x-direction wiring 4 and the anode 5 and between the x-direction wiring 4 and the first potential regulating electrode 6. The circuit 8 supplies the x-direction wiring 4, the anode 5, and the first potential regulating electrode 6 with an electric potential. The circuit 8 supplies the anode 5 with an electric potential (anode potential) that is higher than that supplied to the x-direction wiring 4 and the first potential regulating electrode 6. The electric potentials supplied to the x-direction wiring 4 and the first potential regulating electrode 6 may be different. However, it is desirable that the electric potentials are the same to simplify the configuration. To obtain useful luminance for field emission display apparatuses, the electric potential supplied to the anode 5 is preferably more than or equal to 5 kV, and more preferably more than or equal to 10 kV. In addition, if the electric potential supplied to the anode 5 is too high, the electric discharge easily occurs, although this depends on the distance between the rear plate 1 and the faceplate 2. Thus, practically, the electric potential supplied to the anode 5 is set to less than or equal to 30 kV. The practical electric potential supplied to the x-direction wiring 4 and the first potential regulating electrode 6 ranges from −100 V to 100 V. Typically, the electric potential is set to the ground potential. Note that the circuit 8 may be of any type that can supply electric potentials to the x-direction wiring 4, the anode 5, and the first potential regulating electrode 6. Accordingly, the circuit 8 is not limited to only one circuit. That is, the circuit 8 may include a circuit for supplying an electric potential to the x-direction wiring 4, a circuit for supplying an electric potential to the first potential regulating electrode 6, and a circuit for supplying an electric potential to the anode 5.

Figure 2:
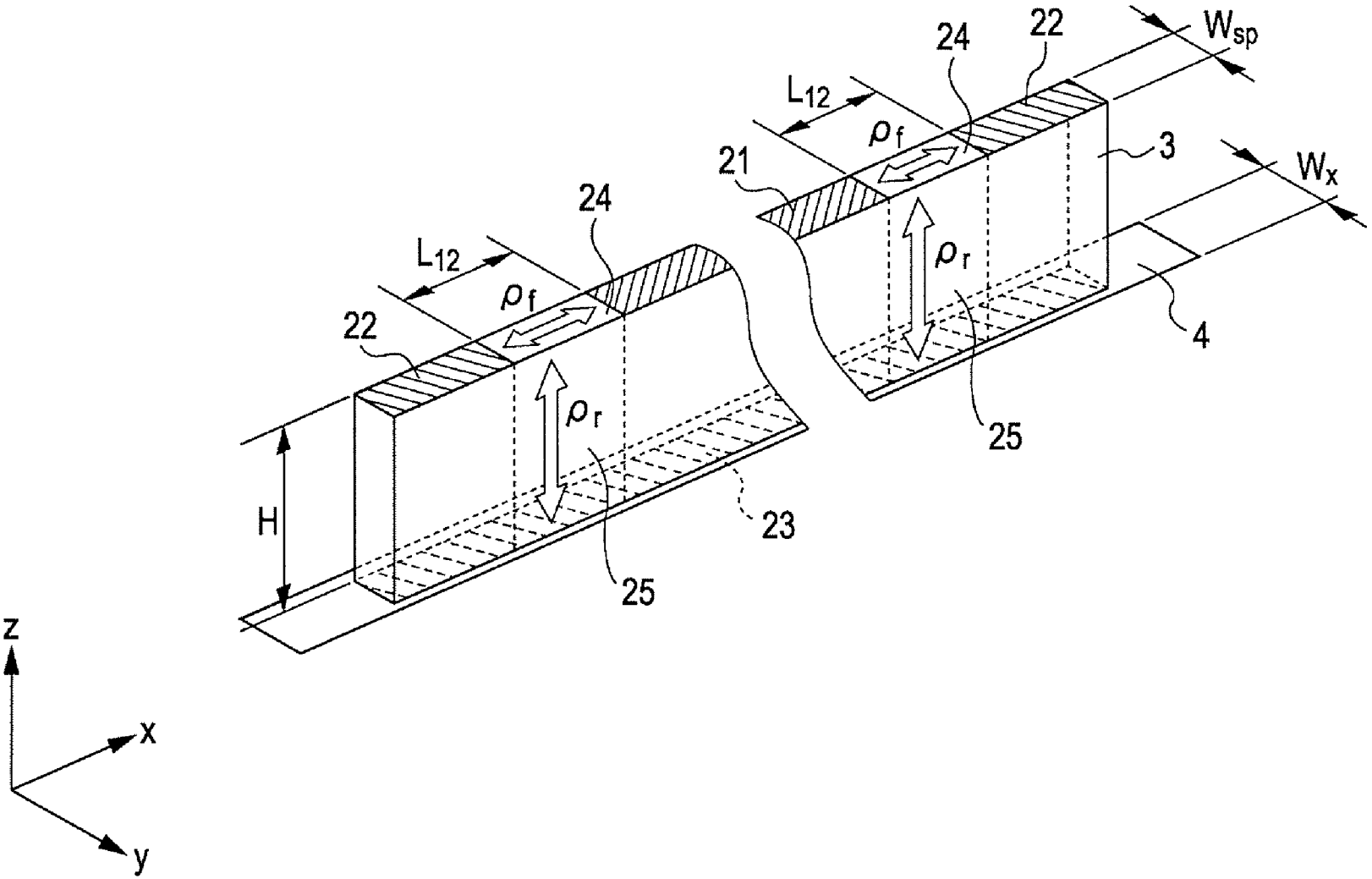
FIG. 2 is another schematic illustration of an exemplary structure of the image display apparatus according to the embodiment of the present invention.

FIG. 2 is a diagram illustrating a positional relationship between the plate-like spacer 3 according to this embodiment and a member for supplying an electric potential to the plate-like spacer 3. In FIG. 2, a first region 21 to which an electric potential is supplied from the anode 5, a second region 22 to which electrical potential is supplied from the first potential regulating electrode 6, a third region 23 to which electrical potential is supplied from the x-direction wiring 4, a region 24 disposed between the first region 21 and the second region 22, and a region 25 disposed between the region 24 and the third region 23 are shown. The y direction is perpendicular to the x direction and the z direction.

According to this exemplary embodiment of the present invention, in the image display apparatus, the x-direction wiring 4, the anode 5, and the first potential regulating electrode 6 can be in contact with the plate-like spacer 3 so as to supply the electric potential. At that time, the first region 21, the second region 22, and the third region 23 serve as a connection region with the anode 5 of the plate-like spacer 3, a connection region with the first potential regulating electrode 6 of the plate-like spacer 3, and a connection region with the x-direction wiring 4 of the plate-like spacer 3, respectively. In addition, when an electric potential is supplied from the anode 5, the first potential regulating electrode 6, and the x-direction wiring 4 to the plate-like spacer 3, a different member can be disposed between the plate-like spacer 3 and each of the anode 5, the first potential regulating electrode 6, and the x-direction wiring 4. At that time, the first region 21, the second region 22, and the third region 23 serve as a connection region between the anode 5 and the different member, a connection region between the first potential regulating electrode 6 and the different member, and a connection region between the x-direction wiring 4 and the different member, respectively.

The plate-like spacer 3 is disposed so that the longitudinal direction of the plate-like spacer 3 is substantially parallel to the x direction. Let $W_x$ denote the width of the x-direction wiring 4 (in the y direction) and $W_{SP}$ denote the width of the plate-like spacer 3 (in the y direction). Then, the width $W_{SP}$ of the plate-like spacer 3 is preferably less than or equal to the width $W_x$ of the x-direction wiring 4. Additionally, it is desirable that the plate-like spacer 3 is disposed in an area between the x-direction wiring 4 and the faceplate 2. The practical width $W_x$ of the x-direction wiring 4 is greater than or equal to 50 μm and less than or equal to 500 μm.

According to this exemplary embodiment of the present invention, the following dimensions are suitable. The width $W_{SP}$ of the plate-like spacer 3 in the y direction is greater than or equal to 50 μm and less than or equal to 200 μm. A height H of the plate-like spacer 3 in the z direction is greater than or equal to 0.5 mm and less than or equal to 5 mm. In order to reduce electric discharge, a distance $L_{12}$ between the first region 21 and the second region 22 can be greater than or equal to 1 mm, although this depends on the difference in electric potential between the anode 5 and the first potential regulating electrode 6. In addition, in order to reduce a peripheral region outside the anode 5 that does not contribute to displaying the image, the distance $L_{12}$ is preferably less than or equal to 5 mm.

Here, let the sheet resistance of an area between the first region 21 and the second region 22 (i.e., the end surface of the plate-like spacer 3) be ρf [Ω/□]. That is, in FIG. 2, let the sheet resistance of an area indicated by a white arrow in the x direction be ρf. Furthermore, let the sheet resistance of an area between the region 24, which is the region between the first region 21 and the second region 22, and the third region 23 (i.e., the side surface of the plate-like spacer 3) be ρr [Ω/□]. That is, in FIG. 2, let the sheet resistance of an area indicated by a white arrow in the z direction be ρr.

According to this exemplary embodiment of the present invention, the relationship between ρr and ρf is determined so that $1/100<\rho r/\rho f\leqq 40$. If this condition is satisfied, the electric field intensity applied to the end portion of the first potential regulating electrode 6 adjacent to the anode 5 can be sufficiently reduced. In addition, the electric field intensity applied to the end portion of the anode 5 adjacent to the first potential regulating electrode 6 can be reduced. Thus, the occurrence of electric discharge can be significantly reduced.

Figure 3A:
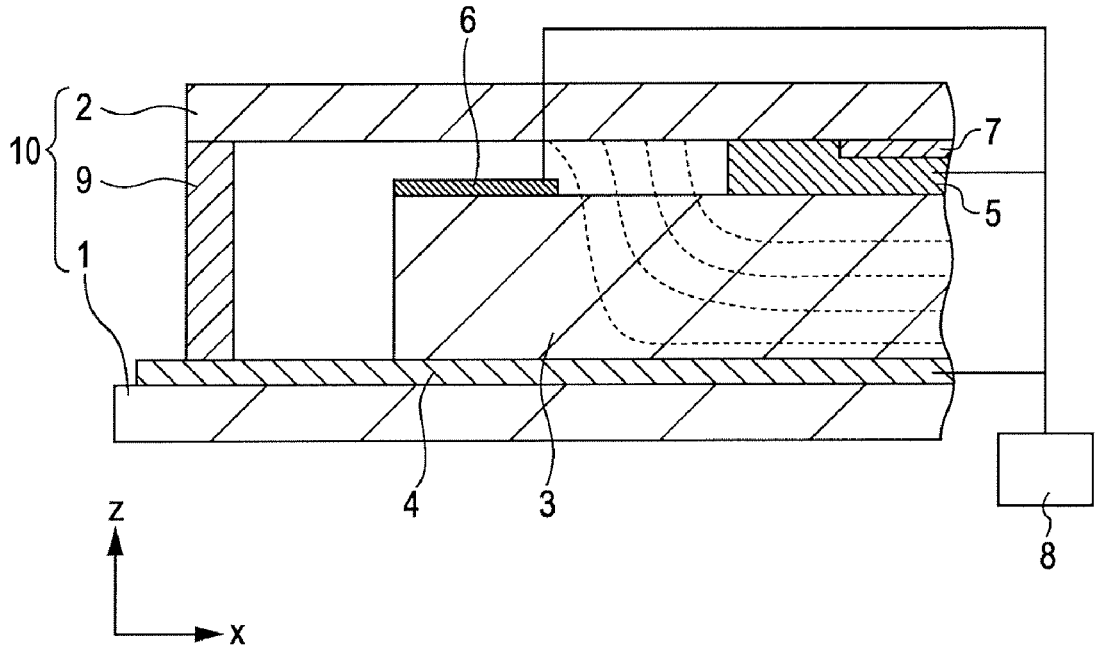
FIGS. 3A and 3B are other schematic illustrations of an exemplary structure of the image display apparatus according to the embodiment of the present invention.
Figure 3B:
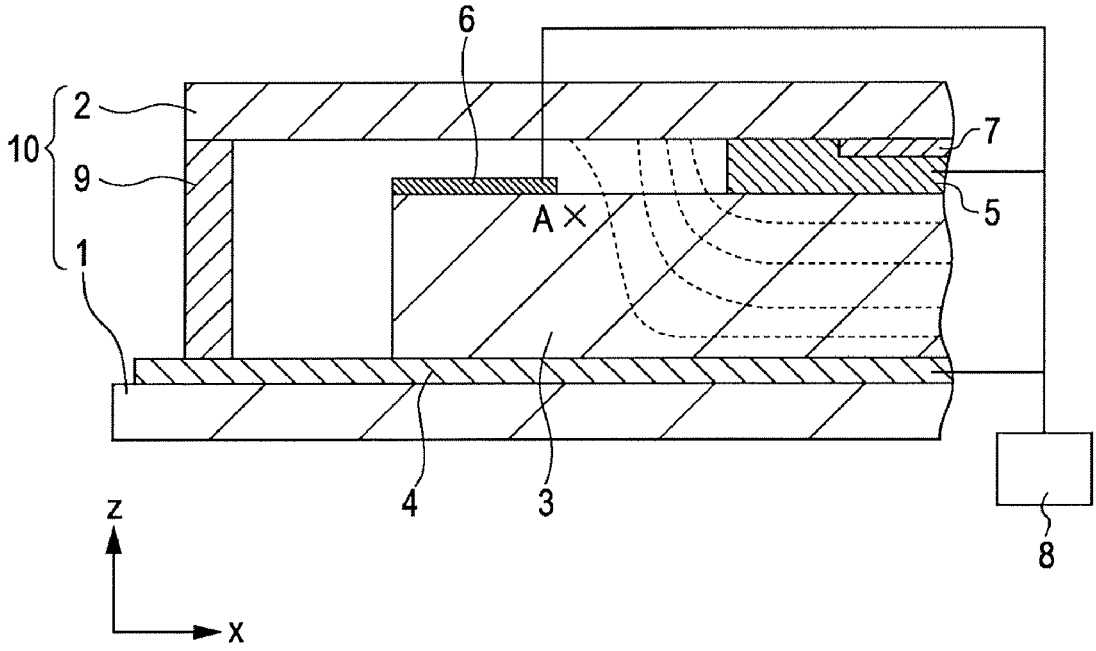

FIGS. 3A and 3B are schematic illustrations of an equipotential line in the cross-sectional view of the image display apparatus shown in FIG. 1. The dotted line in FIGS. 3A and 3B represents the equipotential line.

FIG. 3A illustrates the distribution of the electric potential when the sheet resistance ratio ρr/ρf is greater than 40, that is, when the relationship of the sheet resistances defined by the present exemplary embodiment is not satisfied. In contrast, FIG. 3B illustrates the distribution of the electric potential when the sheet resistance ratio ρr/ρf of the plate-like spacer 3 satisfies the following condition: $1/100<\rho r/\rho f\leqq 40$.

When the sheet resistance ratio ρr/ρf of the plate-like spacer 3 is greater than 40, the equipotential lines between the first potential regulating electrode 6 and the anode 5 have substantially even spacing, as shown in FIG. 3A. In contrast, when the sheet resistance ratio ρr/ρf of the plate-like spacer 3 satisfies the condition $1/100<\rho r/\rho f<40$, the spacing between the equipotential lines between the first potential regulating electrode 6 and the anode 5 increases towards the first potential regulating electrode 6, as shown in FIG. 3B. That is, in FIG. 3B, the electric field intensity around the first potential regulating electrode 6 decreases compared with that shown in FIG. 3A. The reason for this is as follows.

As shown in FIG. 3B, a point A is given near the first region 21 and between the region 24, which is disposed between the first region 21 and the second region 22, and the third region 23. The electric potential at the point A is determined by the sheet resistance of the plate-like spacer 3 and the minimum distance from among the distances between the point A and the first region 21, between the point A and the second region 22, and between the point A and the third region 23.

When the sheet resistance ρr is significantly greater than the sheet resistance ρf, the electric potential at the point A is little effected by the electric potential of the third region 23, and therefore, the electric potential at the point A is determined primarily by the electric potentials of the first region 21 and the second region 22.

In contrast, when the sheet resistance ρr is less than or substantially equal to the sheet resistance ρf, the electric potential at the point A is strongly effected by the electric potential of the third region 23 in addition to the electric potentials of the first region 21 and the second region 22. Accordingly, the electric potential at the point A is decreased compared with the case where the sheet resistance ρr is significantly greater than the sheet resistance ρf.

From the above-described relationship, as the sheet resistance ratio ρr/ρf of the plate-like spacer 3 decreases, the electric potential of the plate-like spacer 3 around the first potential regulating electrode 6 decreases. Thus, the distance between the equipotential lines around the first potential regulating electrode 6 increases, and therefore, the electric field concentrated on the first potential regulating electrode 6 can be reduced.

Figure 4:
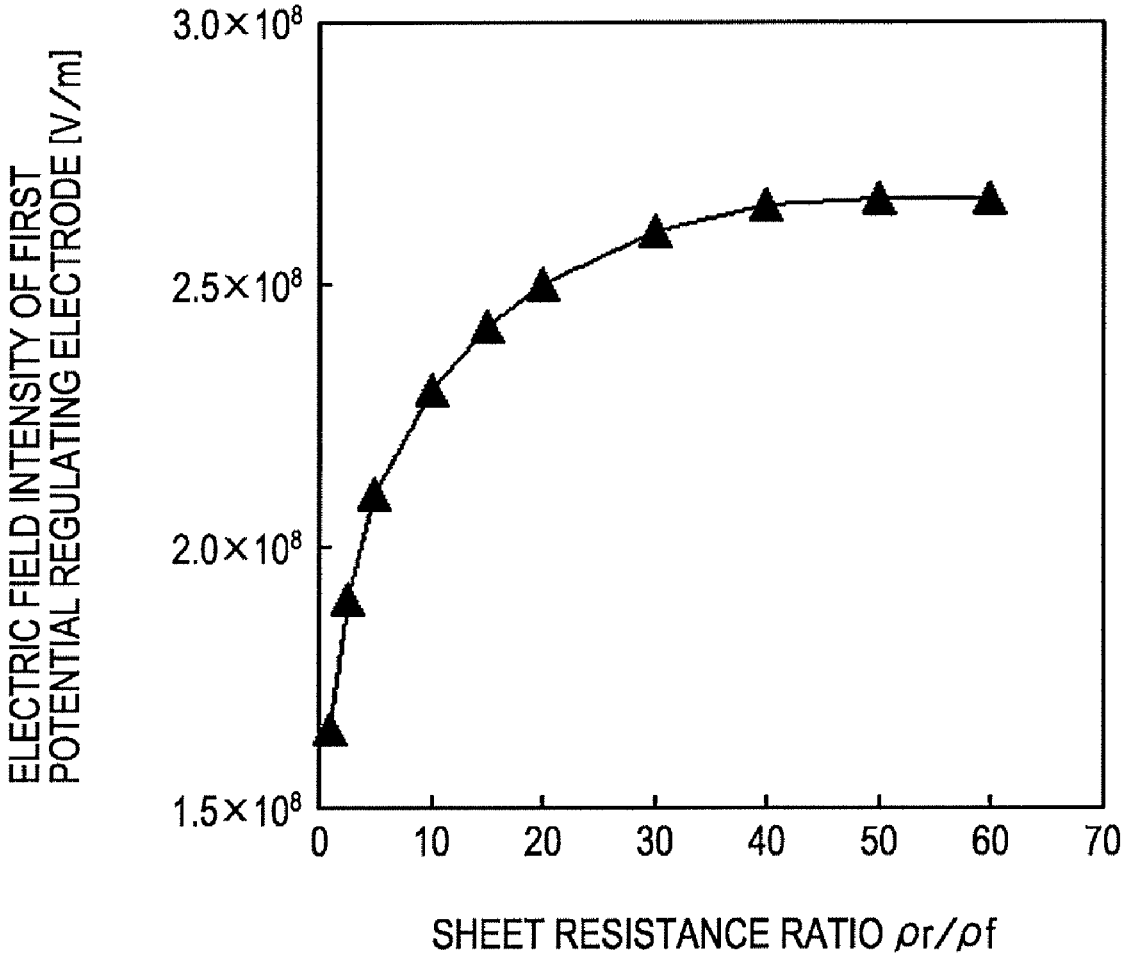
FIG. 4 is a graph illustrating an electrical characteristic of the image display apparatus according to the embodiment of the present invention.

FIG. 4 is a diagram illustrating a relationship between the sheet resistance ratio ρr/ρf of the plate-like spacer 3 and the electric field intensity at an end of the first potential regulating electrode 6 adjacent to the anode 5. The electric potential of the anode 5 was set to 10 kV whereas the electric potentials of the x-direction wiring 4 and the first potential regulating electrode 6 were set to 0 V. The distance $L_{12}$ between the first region 21 and the second region 22 was set to 2 mm, a width $W_{sp}$ of the plate-like spacer 3 in the x-direction was set to 100 μm, a height H of the plate-like spacer 3 in the z direction was set to 1.6 mm, and a width $W_x$ of the x-direction wiring 4 in the x direction was set to 200 μm.

A plurality of plate-like spacers 3 were produced so that the sheet resistance ρf of each of the plate-like spacers 3 was 1.0×10 [Ω/□], and the sheet resistance ρr was greater than or equal to $1.0\times10^{11}$ [Ω/□] and less than or equal to $6.0\times10^{12}$ [Ω/□]. When the sheet resistance ratio ρr/ρf of the plate-like spacer 3 is set to a value less than or equal to 40, the electric field intensity of the first potential regulating electrode 6 is low. Thus, the occurrence of electric discharge around the first potential regulating electrode 6 can be significantly reduced. Accordingly, it is desirable that the sheet resistance ratio ρr/ρf of the plate-like spacer 3 is set to a value less than or equal to 40.

Figure 5:
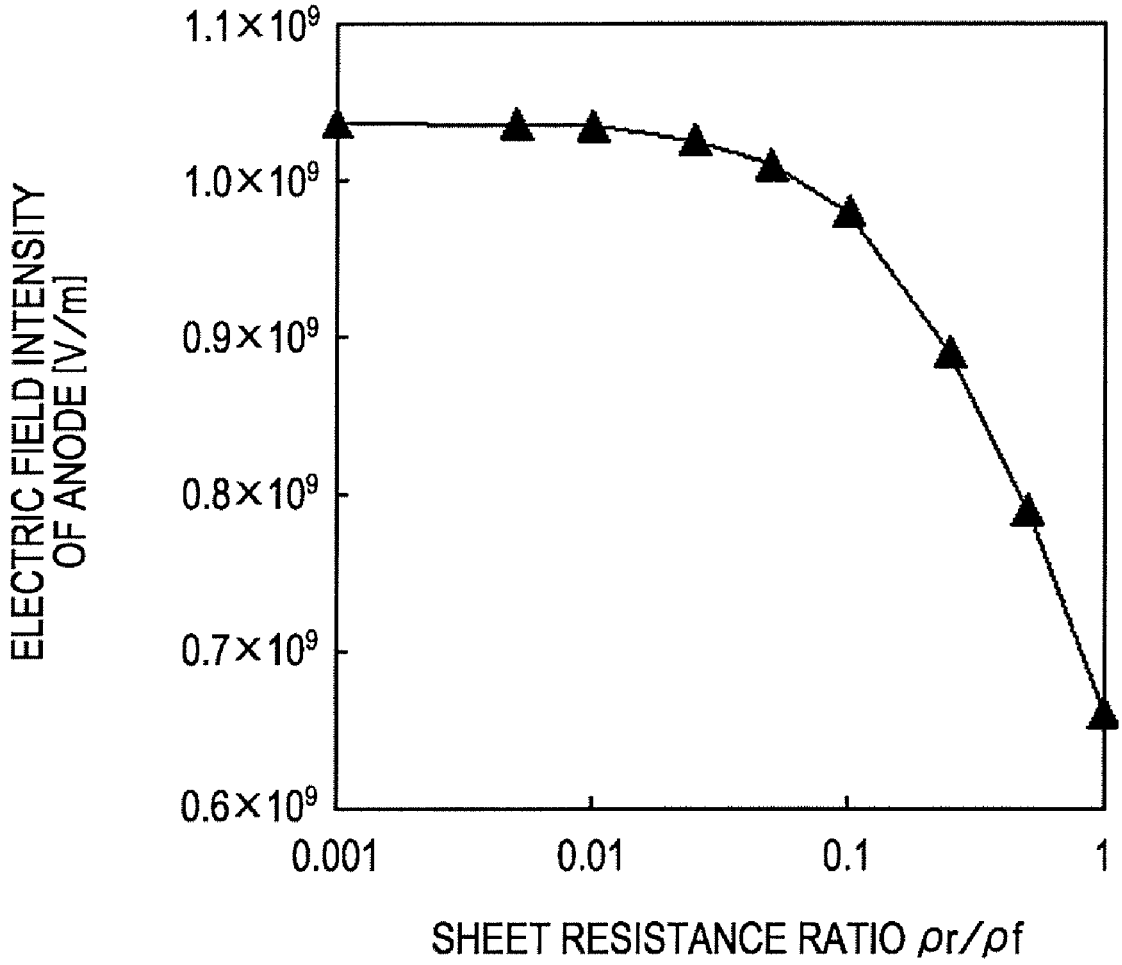
FIG. 5 is a graph illustrating an electrical characteristic of the image display apparatus according to the embodiment of the present invention.

FIG. 5 is a diagram illustrating a relationship between the sheet resistance ratio ρr/ρf of the plate-like spacer 3 and the electric field intensity applied to an end of the anode 5 adjacent to the first potential regulating electrode 6. The conditions, such as the positions and the sizes of the members and the applied voltages, were the same as the conditions illustrated in FIG. 4. As the sheet resistance ratio ρr/ρf of the plate-like spacer 3 was decreased, the distribution of the potential between the first potential regulating electrode 6 and the anode 5 became increasingly distorted. The distance between the equipotential lines around the first potential regulating electrode 6 was decreased whereas the distance between the equipotential lines around the anode 5 was increased. Accordingly, when the sheet resistance ratio ρr/ρf of the plate-like spacer 3 is decreased, the electric field intensity around the first potential regulating electrode 6 decreases. In contrast, the electric field intensity applied to the end of the anode 5 adjacent to the first potential regulating electrode 6 increases. Therefore, a strong coulomb force acts on a member of the anode 5, and thus, the member could be removed. If the removed member floats inside the image display apparatus, electric discharge easily occurs between the anode 5 and another member (e.g., the first potential regulating electrode 6 or the x-direction wiring 4 having a potential different from that of the anode 5). Accordingly, to reduce the electric field intensity concentrated on the end of the anode 5 adjacent to the first potential regulating electrode 6, it is desirable that the sheet resistance ratio ρr/ρf of the plate-like spacer 3 is set to a value greater than 1/100.

As can be seen from the description above, it is desirable that the sheet resistance ratio ρr/ρf of the plate-like spacer 3 is greater than 1/100 and is less than or equal to 40. Furthermore, by setting the sheet resistance ratio ρr/ρf of the plate-like spacer 3 to a value more than or equal to 3 and less than or equal to 10, an excellent image based on the emittance of the fluorescent member can be displayed without distortion at the edge thereof.

Additionally, when the sheet resistance ρf was set to a value greater than or equal to $1.0\times10^{7}$ [Ω/□] and less than or equal to $1.0\times10^{14}$ [Ω/□] and the sheet resistance ratio ρr/ρf of the plate-like spacer 3 was set to a value greater than 1/100 and less than or equal to 40, the electrical discharge was reliably prevented. Furthermore, when the sheet resistance ρr was set to a value greater than or equal to $1.0\times10^{7}$ [Ω/□] and less than or equal to $1.0\times10^{14}$ [Ω/□] and the sheet resistance ratio ρr/ρf of the plate-like spacer 3 was set to a value greater than 1/100 and less than or equal to 40, the electrical discharge was reliably prevented.

Still furthermore, when the sheet resistance ρf or the sheet resistance ρr was set to a value less than $1.0\times10^{7}$ [Ω/□], power consumption of the image display apparatus was increased. In contrast, when the sheet resistance ρf or the sheet resistance ρr was set to a value greater than $1.0\times10^{14}$ [Ω/□], the electric discharge tended to occur over time during operation of the image display apparatus.

The plate-like spacer 3 according to the present exemplary embodiment is described next in detail.

Figure 6A:
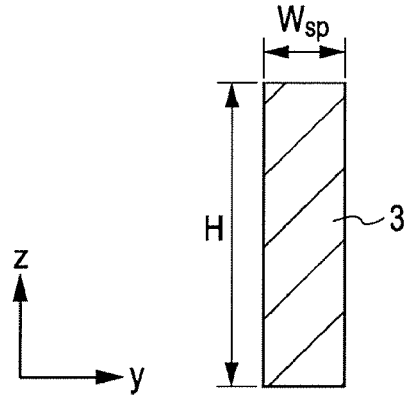
FIGS. 6A-6D are other schematic illustrations of an exemplary structure of the image display apparatus according to the embodiment of the present invention.
Figure 6B:
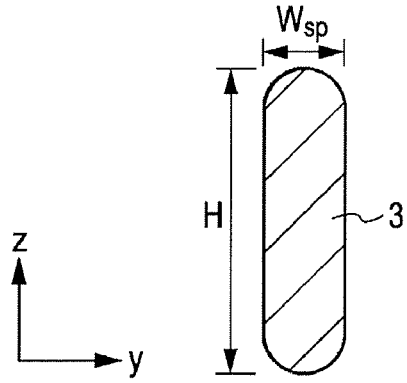
Figure 6C:
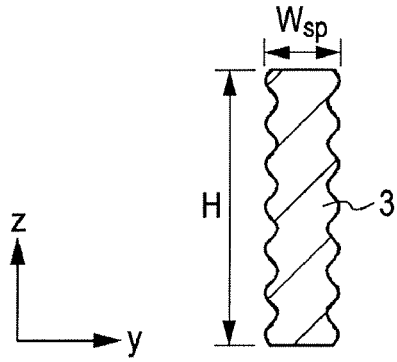

The plate-like spacer 3 according to the present exemplary embodiment can have a variety of forms. FIGS. 6A to 6D illustrate cross-sectional shapes when the first potential regulating electrode 6 is cut by the y-z plane. In general, the plate-like spacer 3 is composed of an electroconductive material and has a rectangular cross section, as shown in FIG. 6A. However, the shape of the cross section is not limited to a rectangular shape. For example, as shown in FIG. 6B, the cross section may be a shape having round corners on the rear plate 1 side and on the faceplate 2 side. Alternatively, as shown in FIG. 6C, the sides of the plate-like spacer 3 may have a plurality of irregularities.

To obtain the sheet resistance ρf and the sheet resistance ρr of different values for the plate-like spacer 3 using an electroconductive material and having the shape shown in one of FIGS. 6A to 6C, the following method can be applied. For example, impurity ions may be implanted into only areas of the plate-like spacer 3 where the sheet resistances are desired to be low or high. Alternatively, only areas of the plate-like spacer 3 where the sheet resistances are desired to be high may be ground down so as to have rough surfaces.

Figure 7A:
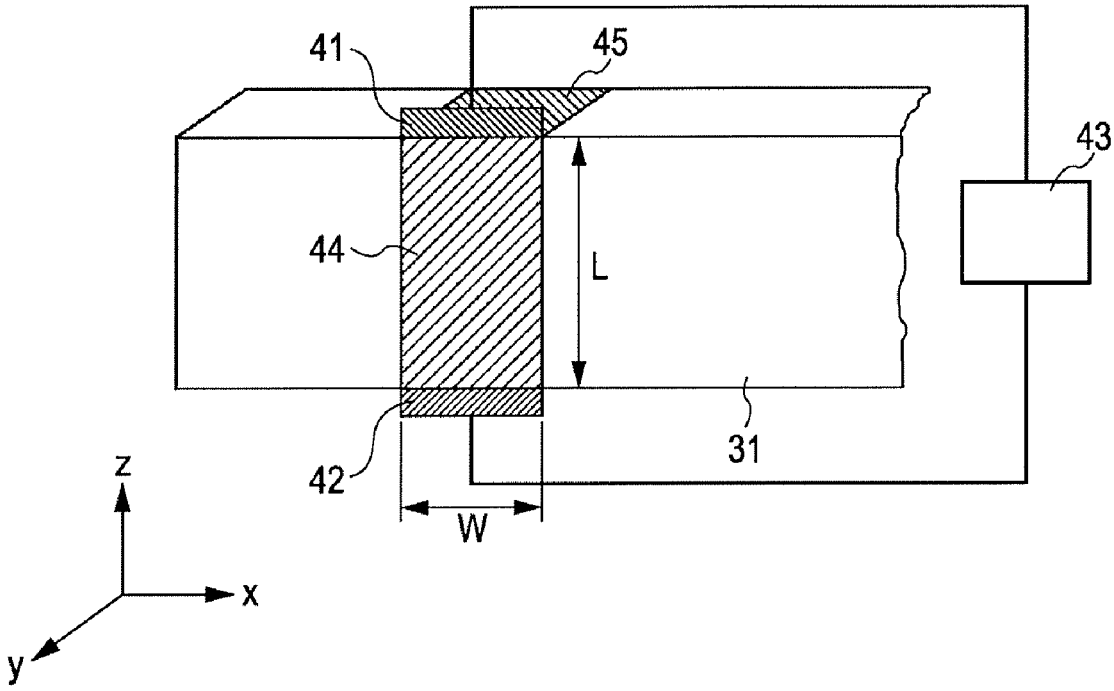
FIGS. 7A and 7B illustrate an exemplary method for computing a sheet resistance value of the image display apparatus according to the embodiment of the present invention.
Figure 7B:
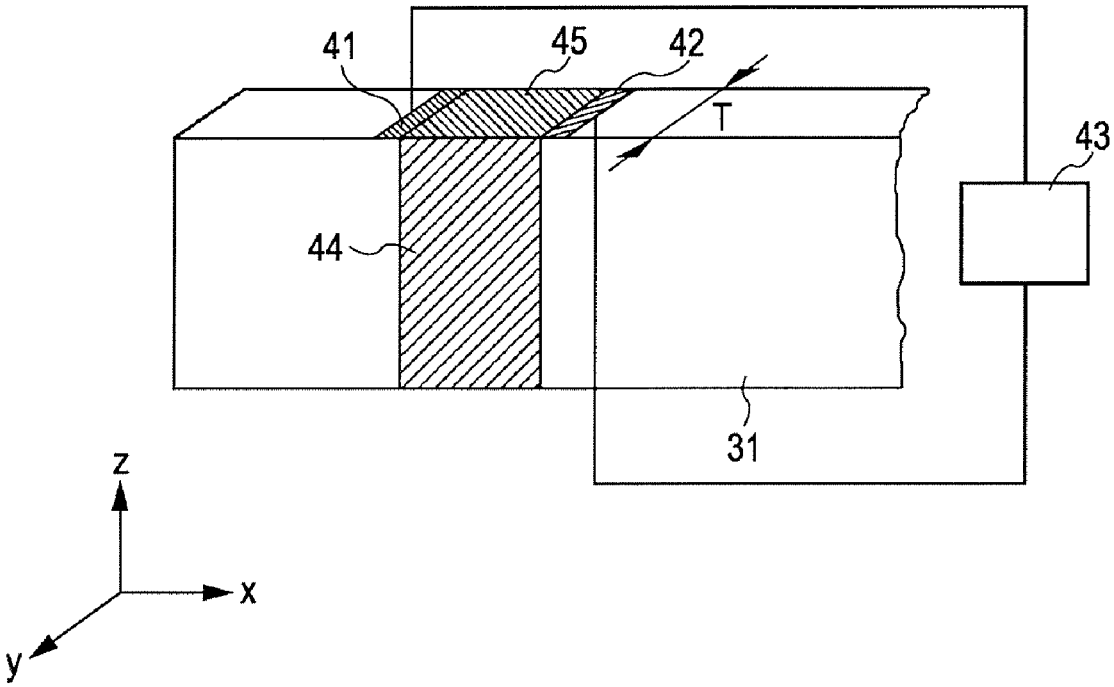

A method for computing the sheet resistance ρf and the sheet resistance ρr of the plate-like spacer 3 using an electroconductive material (see FIGS. 6A to 6C) is described next with reference to FIGS. 7A and 7B. FIGS. 7A and 7B illustrate an exemplary method for measuring the resistance value of the plate-like spacer 3.

First, all regions except for the region 24 disposed between the first region 21 and the second region 22 and the third region 23 disposed between the region 24 and the third region 23 are cut off. That is, as shown in FIG. 7A, a region with no cross hatchings is removed.

Subsequently, an electrode 41 is connected to one end of the region 25 (a region corresponding to a resistive film 44 shown in FIG. 7A) adjacent to the faceplate 2. Note that the region 25 is disposed between the third region 23 and the region 24, which is located between the first region 21 and the second region 22. Similarly, an electrode 42 is connected to the other end of the region 25 adjacent to the rear plate 1. Thereafter, a resistance value Rr of the plate-like spacer 3 between the electrode 41 and the electrode 42 is measured using a measuring instrument 43. Here, let L denote the length of the region of the plate-like spacer 3 remaining after being cut off in the z direction and W denote the length of that region in the x direction. Then, the sheet resistance ρr between the third region 23 and the region 24 disposed between the first region 21 and the second region 22 is computed as: $\rho r = Rr \times W/L$.

Alternatively, in FIG. 7B, the electrode 41 is connected to one end of the region 24 (a region corresponding to a resistive film 45 shown in FIG. 7A) adjacent to the first potential regulating electrode 6. Note that the region 24 is disposed between the first region 21 and the second region 22. The electrode 42 is connected to the other end of the region 24 adjacent to the anode 5. Thereafter, a resistance value Rf of the plate-like spacer 3 between the electrode 41 and the electrode 42 is measured using the measuring instrument 43. Here, let T denote the length of the region of the plate-like spacer 3 remaining after being cut off in the y direction. Then, the sheet resistance ρf between the first region 21 and the second region 22 is computed as: $\rho f = Rf \times T/W$.

The sheet resistances ρr and ρf for the plate-like spacer 3 having a structure shown in one of FIGS. 6B and 6C can be computed in the same way.

Figure 6D:
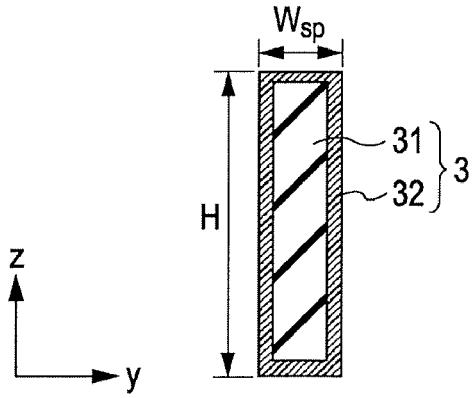

According to the present invention, examples of the structure of the plate-like spacer 3 further include the structure shown in FIG. 6D in which a surface of a base 31 composed of an insulating material is coated with a resistive film 32. It should be noted that the base 31 coated with the resistive film 32 can be applied to the structures shown in FIGS. 6B and 6C. In FIG. 6D, the entire periphery of the base 31 is coated with the resistive film 32. However, the resistive film 32 can be disposed on the base 31 in at least an area that forms the side surface of the plate-like spacer 3.

The plate-like spacer 3 having the structure shown in FIG. 6D is described next.

The base 31 can be composed of a material having a mechanical strength that is sufficient to withstand atmospheric pressure applied to the rear plate 1 and the faceplate 2 of the image display apparatus. Examples of the material of the base 31 include a quartz glass, a glass having a low impurity content, such as Na, a soda lime glass, and a ceramic material, such as alumina.

To reduce electrostatic charge mainly caused by electrons impinging onto the side surface of the plate-like spacer 3, the resistive film 32 can have a sheet resistance that sufficiently reduces such electrostatic charge. Practically, the sheet resistance of the resistive film 32 disposed on the surface of the plate-like spacer 3 is preferably less than or equal to $1.0\times10^{14}$ [Ω/□] and, more preferably, less than or equal to $1.0\times10^{12}$ [Ω/□]. However, if the sheet resistance of the resistive film 32 coating the base 31 is low, power consumption of the image display apparatus increases due to an electric current flowing through the resistive film 32. Accordingly, it is desirable that the sheet resistance of the resistive film 32 disposed on the surface of the plate-like spacer 3 is greater than or equal to $1.0\times10^{7}$ [Ω/□]. Examples of a material for the resistive film 32 include a metal oxide (such as chrome oxide, nickel oxide, and copper oxide), aluminum-transition metal nitride, germanium-transition metal nitride, and a carbon (such as amorphous carbon). Examples of a transition metal element include Ti, V, Cr, Mn, Fe, Co, Ni, Cu, Zr, Nb, Mo, W, Hf, and Ta. Such a transition metal in the nitride may be used by itself, or at least two types of transition metal element may be used together.

Examples of a method for forming the resistive film 32 on the base 31 include a vapor-phase deposition method (such as sputtering, electron beam evaporation, ion plating, ion assist evaporation, CVD, or plasma CVD) and a liquid-phase deposition method (such as spraying or dipping).

To achieve a structure of the plate-like spacer 3 in which the sheet resistance ρf is different from the sheet resistance ρr, the plate-like spacer 3 is formed in the following way, for example.

First, a material of the resistive film 32 is coated over the entire surface of the base 31 so that the desired highest sheet resistance is obtained by adjusting the duration of deposition of the resistive film 32 on the base 31. Subsequently, the material of the resistive film 32 is further deposited only on areas of the resistive film 32 whose sheet resistance is desired to be decreased so that the desired sheet resistance can be obtained by adjusting the duration of deposition. That is, according to this method, by adjusting the duration of deposition of the material of the resistive film 32, the thickness of the formed resistive film 32 can be changed, and therefore, the sheet resistance of the resistive film 32 can be controlled. Alternatively, by depositing different materials of the resistive film 32 on an area whose sheet resistance is desired to be increased and an area whose sheet resistance is desired to be decreased, the sheet resistance of the resistive film 32 can be controlled.

A method for computing the sheet resistance ρf and the sheet resistance ρr of the plate-like spacer 3 in which the base 31 is coated with the resistive film 32 (see FIG. 6D) is described next with reference to FIGS. 7A and 7B.

First, the entire region of the resistive film except for a predetermined region is removed by etching. That is, the region of the resistive film not to be removed is the region 24 located between the first region 21 and the second region 22. Hereinafter, this resistive film is referred to as a "resistive film 45". In addition, a resistive film in the region 25 located between the third region 23 and the region 24 located between the first region 21 and the second region 22 is not removed. Hereinafter, this resistive film is referred to as a "resistive film 44". The insulating base 31 is exposed through the areas where the resistive films of the plate-like spacer 3 are removed.

Subsequently, as shown in FIG. 7A, an electrode 41 is connected to one end of the resistive film 44 adjacent to the faceplate 2. Similarly, an electrode 42 is connected to the other end of the resistive film 44 adjacent to the rear plate 1. Thereafter, a resistance value Rr of the resistive film 44 between the electrode 41 and the electrode 42 is measured using the measuring instrument 43. Here, let L denote the length of the region of the resistive film 44 in the z direction and W denote the length of the resistive film 44 in the x direction. Then, the sheet resistance ρr between the third region 23 and the region 24 disposed between the first region 21 and the second region 22 is computed as: $\rho r = Rr \times W/L$.

Alternatively, as shown in FIG. 7B, the electrode 41 is connected to one end of the resistive film 45 adjacent to the first potential regulating electrode 6. The electrode 42 is connected to the other end of the resistive film 45 adjacent to the anode 5. Thereafter, a resistance value Rf of the resistive film 45 between the electrode 41 and the electrode 42 is measured using the measuring instrument 43. Here, let T denote the length of the resistive film 45 in the y direction. Then, the sheet resistance ρf between the first region 21 and the second region 22 is computed as: $\rho f = Rf \times T/W$.

The whole structure of the image display apparatus according to the present embodiment is described next with reference to FIG. 8.

Figure 8:
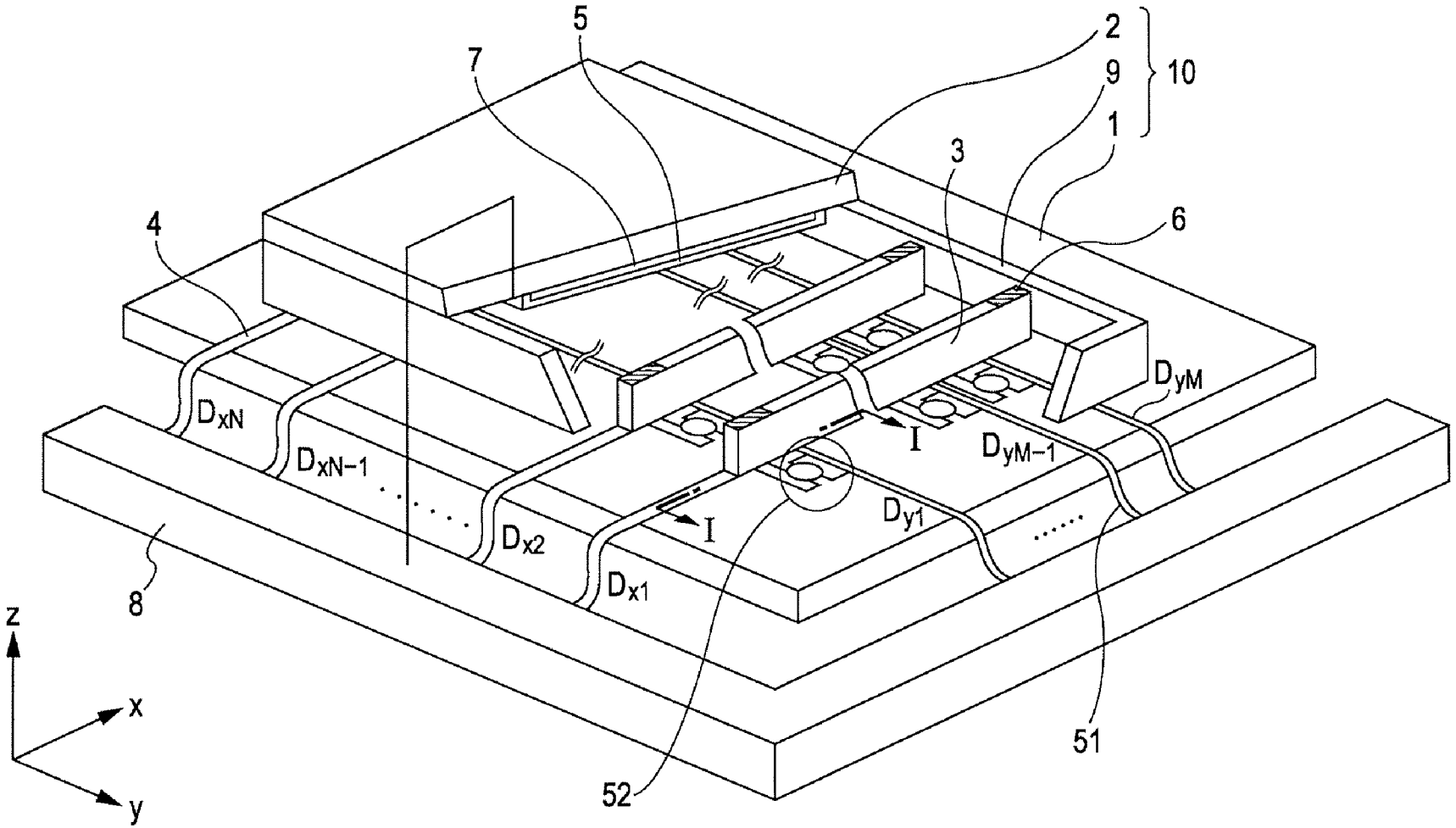
FIG. 8 is another schematic illustration of an exemplary structure of the image display apparatus according to the embodiment of the present invention.

FIG. 8 is a schematic perspective view of the image display apparatus shown in FIG. 1. In FIG. 8, parts of the image display apparatus are removed in order to illustrate the internal structure thereof. As shown in FIG. 8, the image display apparatus includes a y-direction wiring 51 and an electron emitting device 52. For simplicity, in the image display apparatus shown in FIGS. 7A and 7B, parts of the electron emitting device 52, the x-direction wiring 4, the y-direction wiring 51, and the plate-like spacer 3 are not shown. Additionally, FIG. 1 is a schematic illustration of an enlarged perspective view around the anode 5 taken along line I-I of FIG. 8.

The y-direction wiring 51 is disposed on the rear plate 1 so as to extend in a direction perpendicular to the x-direction wiring 4. The x-direction wiring 4 can be disposed so as to intersect the y-direction wiring 51. In this case, the x-direction wiring 4 is disposed above the y-direction wiring 51 with an insulating layer (not shown) therebetween at the intersection between the x-direction wiring 4 and the y-direction wiring 51.

The y-direction wiring 51 may be disposed in a groove formed on the surface of the rear plate 1. Alternatively, the y-direction wiring 51 and the insulating layer (not shown) located between the y-direction wiring 51 and the x-direction wiring 4 at the intersection thereof may be disposed in a groove formed on the surface of the rear plate 1. In this case, the y-direction wiring 51 and the insulating layer are disposed in the groove formed on the surface of the rear plate 1 and the x-direction wiring 4 is disposed so as to intersect with the y-direction wiring 51. In this way, the x-direction wiring 4 is disposed on a surface that is substantially flat. Accordingly, the plate-like spacer 3 can be reliably connected to the x-direction wiring 4.

The circuit 8 amplifies or decreases the electric potential supplied from a power supply unit, such as a power outlet at home or a battery, disposed outside the image display apparatus so as to convert the electric potential to a predetermined electric potential. The circuit 8 includes, for example, a transformer, a coil, a resistor, and a wiring.

The circuit 8 supplies an electric potential that is lower than that of the anode 5 to the x-direction wiring 4 and the y-direction wiring 51. Practically, an electric potential in the range from −100 V to 100 V is applied to the x-direction wiring 4 and the y-direction wiring 51.

FIG. 8 illustrates a structure in which the plate-like spacer 3 is provided on each of a plurality of the x-direction wirings 4.

Each of a plurality of the plate-like spacers 3 in the image display apparatus is disposed on the corresponding one of the x-direction wirings 4 so that the longitudinal direction of each of the plate-like spacers 3 is substantially parallel to the x direction. The plate-like spacers 3 may be disposed on every other x-direction wiring 4 or on every few x-direction wirings 4. That is, for example, the plate-like spacers 3 may be disposed on the odd-numbered (even-numbered) x-direction wirings 4. Alternatively, n x-direction wirings 4 may be disposed between two adjacent x-direction wirings 4 on which the plate-like spacers 3 are disposed, where $n \geqq 2$.

An electroconductive material can be used for the first potential regulating electrode 6 provided on the plate-like spacer 3. It is desirable that the electroconductive material is a metal, such as Al or Cu.

The electric potential of the first potential regulating electrode 6 is supplied from the circuit 8. In addition, a wiring (not shown) can be provided on the plate-like spacer 3 so that the first potential regulating electrode 6 is connected to the x-direction wiring 4. This wiring can be disposed, for example, at the end of the plate-like spacer 3 in the x direction. Furthermore, this wiring can be disposed in the region located between the second region 22 and the third region 23. This arrangement of the wiring allows the electric potential of the x-direction wiring 4 to be supplied to the first potential regulating electrode 6. Still furthermore, this wiring may be integrated into the first potential regulating electrode 6.

Each of a plurality of the electron emitting devices 52 is connected to any one of the x-direction wirings 4 and is connected to any one of the y-direction wirings 51.

According to the present invention, a typical example of the electron emitting device 52 is a surface conduction electron emitting device. However, the present invention is not limited thereto. For example, an MIM electron emitting device, an MIS electron emitting device, or a field electron emitting device may be used for the electron emitting device 52. A typical example of the field electron emitting device is an electron emitting device known as a Spindt-type electron emitting device including an electron emitter formed by microfabricating a metal or a semiconductor into a cone shape or a quadrangular pyramid shape. Alternatively, a field electron emitting device may include a carbon fiber having a nano-scale diameter, such as a carbon nanotube or a graphite nanofiber, serving as the electron emitter.

In the image display apparatus according to the present invention, the circuit 8 supplies an electric potential to the x-direction wiring 4 and the y-direction wiring 51 so that the electron emitting device 52 connected to the x-direction wiring 4 and the y-direction wiring 51 emits electrons. The emitted electrons are accelerated towards the anode 5 to which the circuit 8 supplies an electric potential higher than that for the x-direction wiring 4 and the y-direction wiring 51.

Figure 9:
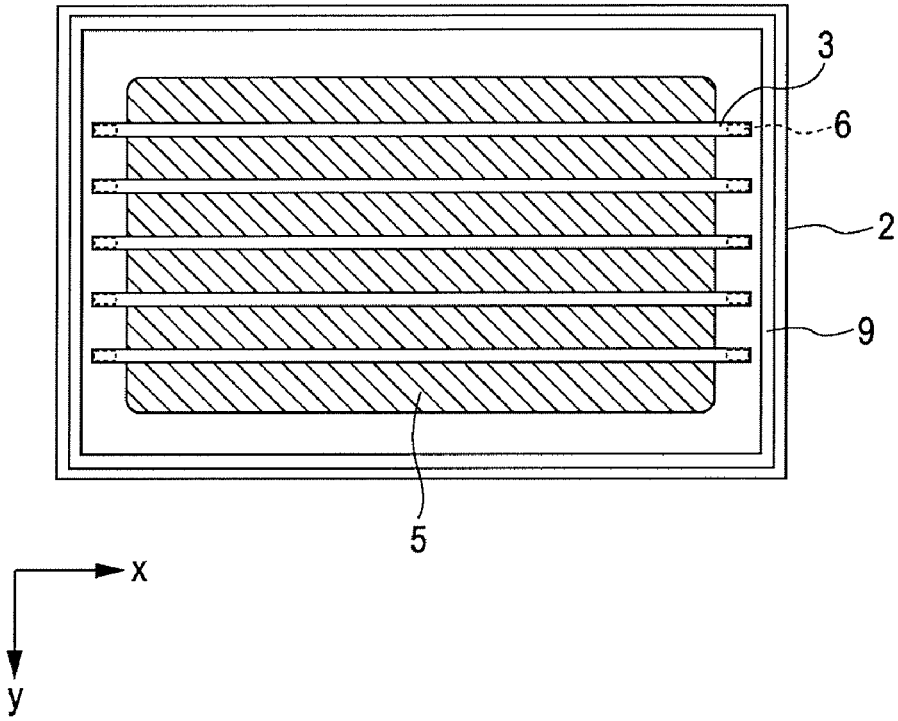
FIG. 9 is another schematic illustration of an exemplary structure of the image display apparatus according to the embodiment of the present invention.

The faceplate 2 included in the image display apparatus according to the present invention is described next with reference to FIG. 9. FIG. 9 is a plan view of the surface of the faceplate 2 of the image display apparatus viewed from the rear plate 1 side. In FIG. 9, to illustrate the positional relationship between the faceplate 2 and the plate-like spacer 3, the plate-like spacer 3 is shown. The end of the second region is indicated by a dashed line.

The length in the longitudinal direction of the plate-like spacer 3 can be longer than that of the anode 5 in the same direction. In the image display apparatus shown in FIG. 9, the longitudinal direction of the plate-like spacer 3 corresponds to the x direction. Additionally, either end of the plate-like spacer 3 in the longitudinal direction can be located outside a plane to the anode 5, wherein the plane passes through the end of the first potential regulating electrode 6 adjacent to the anode 5 and whose normal direction is a direction in which the anode 5 faces the first potential regulating electrode 6. Thus, an electric field concentrated on the end of the plate-like spacer 3 in the longitudinal direction can be reduced, and therefore, the occurrence of electric discharge can be reduced.

The faceplate 2 can be composed of a glass. The fluorescent member 7 and the anode 5 are disposed on the surface of the faceplate 2 adjacent to the rear plate 1.

An anode potential Va is applied to the anode 5 in order to accelerate the electrons emitted from the electron emitting device 52.

Any material that emits light when irradiated with an electron beam can be used for the fluorescent member 7. In general, a fluorescent member that can be used for a cathode-ray tube (CRT) is used for the fluorescent member 7.

In the image display apparatus according to the present invention, the anode 5 can be disposed so as to cover the fluorescent member 7 disposed on the surface of the faceplate 2.

In such a case, a metallic film (e.g., an aluminum film) can be used for the material of the anode 5.

In order to maintain a pressure inside the envelope 10 formed from the rear plate 1, the side wall 9, and the faceplate 2, a film formed from a getter material, such as Ba or Ti, is preferably provided on the metallic film. In such a case, the anode 5 includes the metallic film and the getter film.

In addition, to increase the contrast of a displayed image, an electroconductive black member having a plurality of openings (a black matrix) (not shown) may be disposed on the faceplate 2. Each of the openings corresponds to a pixel of R, G, or B. The corresponding fluorescent member is disposed in each opening. A low-melting glass containing carbon black or a black pigment can be used for the material of the black member. In such a case, the anode 5 includes the black member and the metallic film in the case of not disposing the getter film and includes the black member, the metallic film, and the getter film in the case of disposing the getter film.

In contrast, when the conductive black member having the plurality of openings is disposed on the faceplate 2, a light-transmissive electroconductive film may be disposed between the black member and the faceplate 2 in place of the metallic film. An ITO or a tin oxide can be used for the material of the light-transmissive electroconductive film. In such a case, the anode 5 includes the black member and the light-transmissive electroconductive film.

In addition, a video signal receiving and display apparatus can be provided using the image display apparatus according to the present invention illustrated with reference to, for example, FIG. 8.

Figure 10:
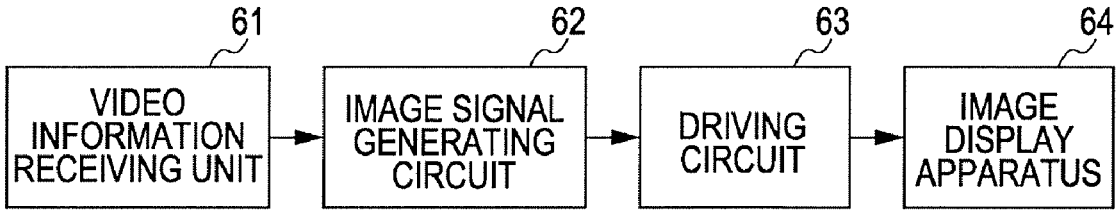
FIG. 10 is a block diagram of a video signal receiving and display apparatus according to an embodiment of the present invention.

FIG. 10 illustrates an exemplary structure of the video signal receiving and display apparatus using the image display apparatus according to the present exemplary embodiment. As shown in FIG. 10, the video signal receiving and display apparatus includes a video information receiving unit 61, an image signal generating circuit 62, a driving circuit 63, and the image display apparatus 64 according to the present invention. The video information receiving unit 61 selects a channel and receives a video signal. The video information receiving unit 61 then inputs the received video signal to the image signal generating circuit 62. Thus, an image signal is generated. An example of the video information receiving unit 61 is a receiver, such as a tuner that selects and receives a video channel via a radio broadcast, a cable broadcast, or the Internet. In addition, by connecting an audio unit to the video information receiving unit 61, a television set that includes the audio unit, the image signal generating circuit 62, the driving circuit 63, and the image display apparatus 64 can be achieved. The image signal generating circuit 62 generates an image signal corresponding to each of the pixels of the image display apparatus 64 on the basis of the video information and inputs the image signal to the driving circuit 63. The driving circuit 63 then controls the voltage applied to the image display apparatus 64 on the basis of the input image signal. Thus, the image display apparatus 64 can display the image.

According to the image display apparatus of the present exemplary embodiment, the electric field concentrated on the first potential regulating electrode 6 can be reduced, and therefore, the image display apparatus that can reduce the occurrence of electric discharge can be achieved.

Second Exemplary Embodiment

Figure 11:
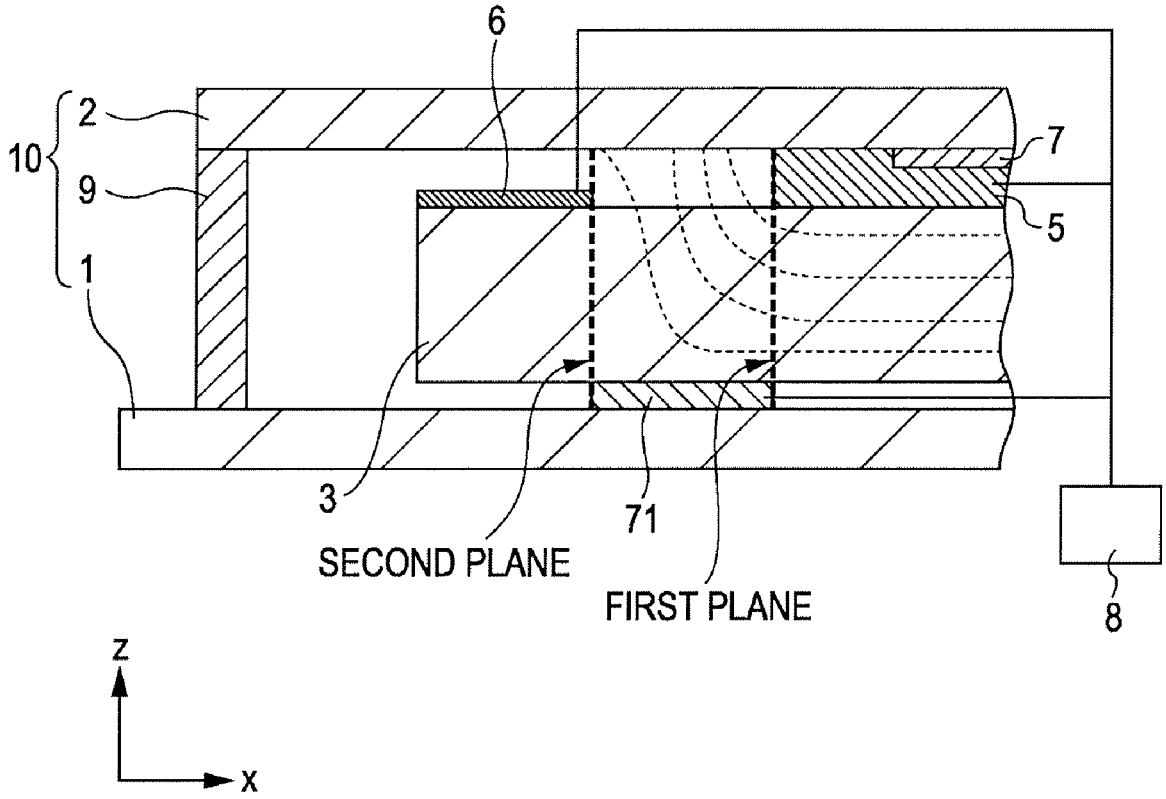
FIG. 11 is a schematic illustration of another image display apparatus according to a further embodiment of the present invention.

An image display apparatus according to a second exemplary embodiment is described next with reference to FIGS. 11 and 12. FIG. 11 is a schematic illustration of a cross section of the image display apparatus according to the second exemplary embodiment. FIG. 11 corresponds to FIG. 1 of the first exemplary embodiment. As shown in FIG. 11, the image display apparatus includes a second potential regulating electrode (a third electroconductive member) 71. A dashed line denotes an equipotential line. The image display apparatus according to the second exemplary embodiment has a structure similar to that of the first exemplary embodiment except that the second potential regulating electrode 71 is provided in place of the x-direction wiring 4 that provides an electric potential to the plate-like spacer 3. The difference between the structure of the image display apparatus of the second exemplary embodiment and that shown in FIG. 1 is described below. Similar numbering will be used in describing FIGS. 11 and 12 as was utilized above in describing FIG. 1.

The circuit 8 supplies the second potential regulating electrode 71 with an electric potential that is lower than that of the anode 5. The electric potential supplied to the second potential regulating electrode 71 is preferably the same as that supplied to the first potential regulating electrode 6. The second potential regulating electrode 71 then supplies an electric potential to the plate-like spacer 3. For example, the second potential regulating electrode 71 may be the y-direction wiring 51 shown in FIG. 8 or may be wirings (not shown) extending parallel to the y-direction wiring 51 on opposite sides of the y-direction wiring 51. Alternatively, the second potential regulating electrode 71 may be disposed on the x-direction wiring 4 with an insulating layer therebetween.

Figure 12:
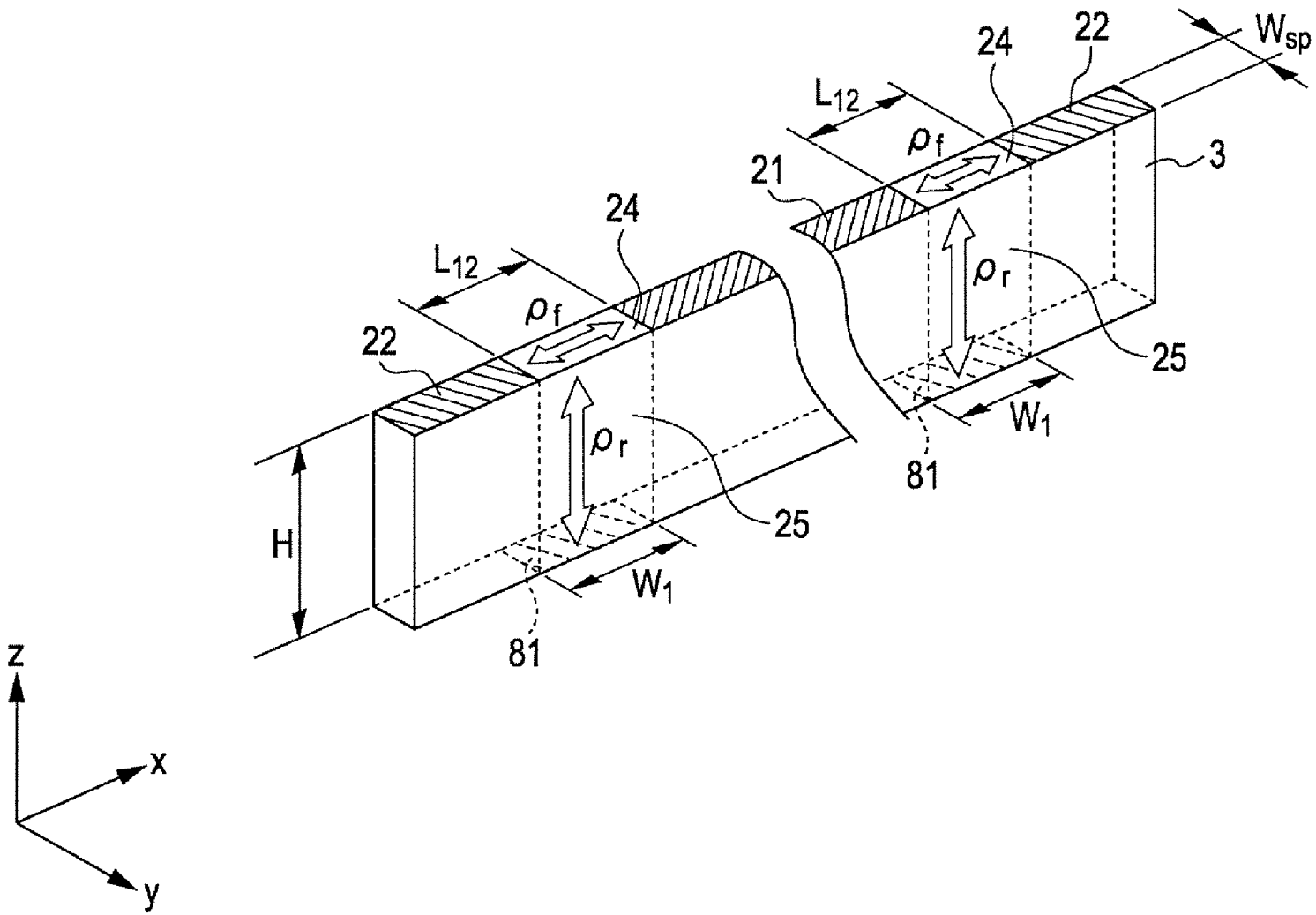
FIG. 12 is a schematic illustration of another image display apparatus according to the embodiment of the present invention.

FIG. 12 is a diagram illustrating the positional relationship between the plate-like spacer 3 according to the present exemplary embodiment and a member for supplying an electric potential to the plate-like spacer 3. In FIG. 12, a third region 81 of the plate-like spacer 3 is shown. An electric potential is supplied from the second potential regulating electrode 71 to the third region 81.

Here, let a plane that passes through the end of the anode 5 adjacent to the first potential regulating electrode 6 and whose normal direction is a direction in which the anode 5 faces the first potential regulating electrode 6 denote a "first plane". Let a plane that passes through the end of the first potential regulating electrode 6 adjacent to the anode 5 and whose normal direction is the direction in which the anode 5 faces the first potential regulating electrode 6 denote a "second plane". In the present exemplary embodiment, the second potential regulating electrode 71 is disposed so that at least part of the plate-like spacer 3 is located between the first plane and the second plane and, in addition, the first plane and the second plane pass through the third region 81. A length $W_1$ of the third region 81 in the x direction is greater than or equal to the distance $L_{12}$ between the first region 21 and the second region 22. In addition, the length of the third region 81 in the y direction is greater than or equal to the length of the plate-like spacer 3 in the y direction.

Subsequently, the sheet resistance ratio $\rho r/\rho f$ of the plate-like spacer 3 is determined so that $1/100<\rho r/\rho f\leqq 40$. In this way, the electric field intensity applied to the first potential regulating electrode 6 can be decreased. In addition, the electric field concentrated on the end of the anode 5 adjacent to the first potential regulating electrode 6 can be decreased, and therefore, the occurrence of electric discharge can be reduced.

According to the second exemplary embodiment, the electric field concentrated on the first potential regulating electrode 6 can be decreased, and therefore, the image display apparatus that can reduce the occurrence of electric discharge can be achieved.

Third Exemplary Embodiment

Figure 13:
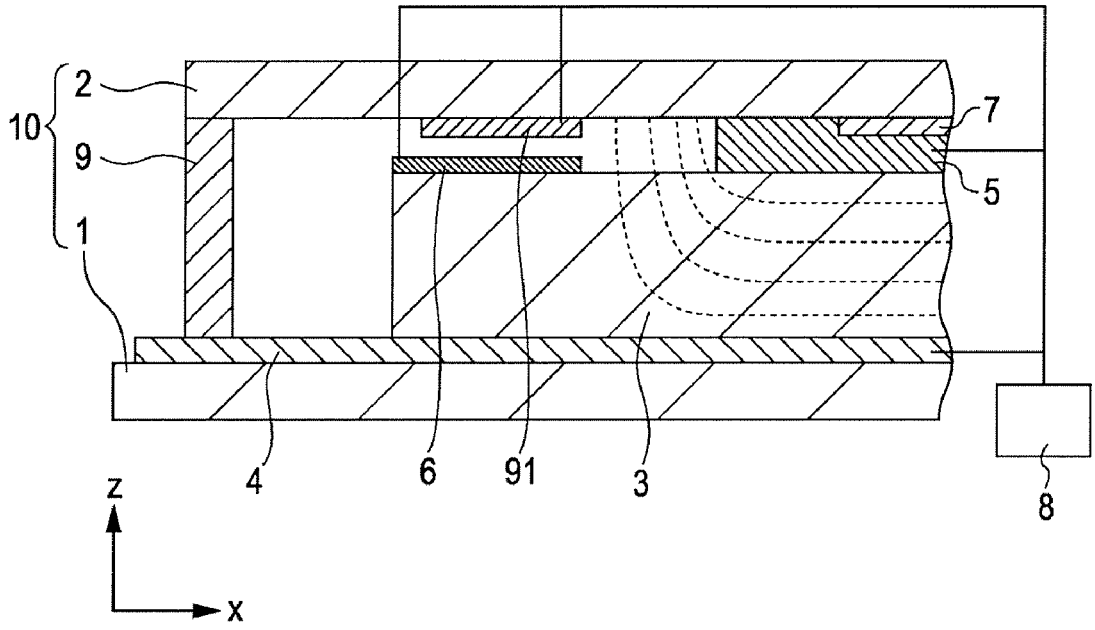
FIG. 13 is a schematic illustration of another image display apparatus according to another embodiment of the present invention.

An image display apparatus according to a third exemplary embodiment is described next with reference to FIG. 13. FIG. 13 is a schematic illustration of a cross section of the image display apparatus according to the third exemplary embodiment. FIG. 13 corresponds to FIG. 1 of the first exemplary embodiment. As shown in FIG. 13, the image display apparatus includes a third potential regulating electrode (a fourth electroconductive member) 91. A dashed line denotes an equipotential line. The image display apparatus according to the third exemplary embodiment has a structure similar to that of the first exemplary embodiment except that the third potential regulating electrode 91 is provided on the faceplate 2. The difference between the structure of the image display apparatus of the third exemplary embodiment and that of the first exemplary embodiment is described below. Similar numbering will be used in describing FIG. 13 as was utilized above in describing FIG. 1.

In the first exemplary embodiment, the first potential regulating electrode 6 is disposed on the plate-like spacer 3, and an electric potential that is lower than that of the anode 5 is supplied to the first potential regulating electrode 6. However, if the anode potential applied to the anode 5 is increased, the intensity of electric field applied to the corner of the end of the plate-like spacer 3 in the longitudinal direction (the x direction) and the structure, such as a securing member for securing the plate-like spacer 3 increases. Thus, a different method for reducing electric discharge may be needed.

In the third exemplary embodiment, the third potential regulating electrode 91 is disposed between the faceplate 2 and the first potential regulating electrode 6. The circuit 8 supplies the third potential regulating electrode 91 with an electric potential that is lower than that of the anode 5. Accordingly, furthermore, the electric field concentration on the corner of the plate-like spacer 3 and the structure can be reduced. The third potential regulating electrode 91 may be disposed so as to be separated from the first potential regulating electrode 6 without contacting the first potential regulating electrode 6. However, if the third potential regulating electrode 91 is in contact with the first potential regulating electrode 6, furthermore, the electric field concentration on the corner of the plate-like spacer 3 and the structure can be reduced. In addition, if the third potential regulating electrode 91 is in contact with the first potential regulating electrode 6, an electric potential can be supplied from the first potential regulating electrode 6 to the third potential regulating electrode 91.

The electric potential supplied to the third potential regulating electrode 91 is preferably the same as that supplied to the first potential regulating electrode 6 and the x-direction wiring 4. The practical electric potential supplied to the third potential regulating electrode 91 ranges from −100 V to 100 V.

Figure 14:
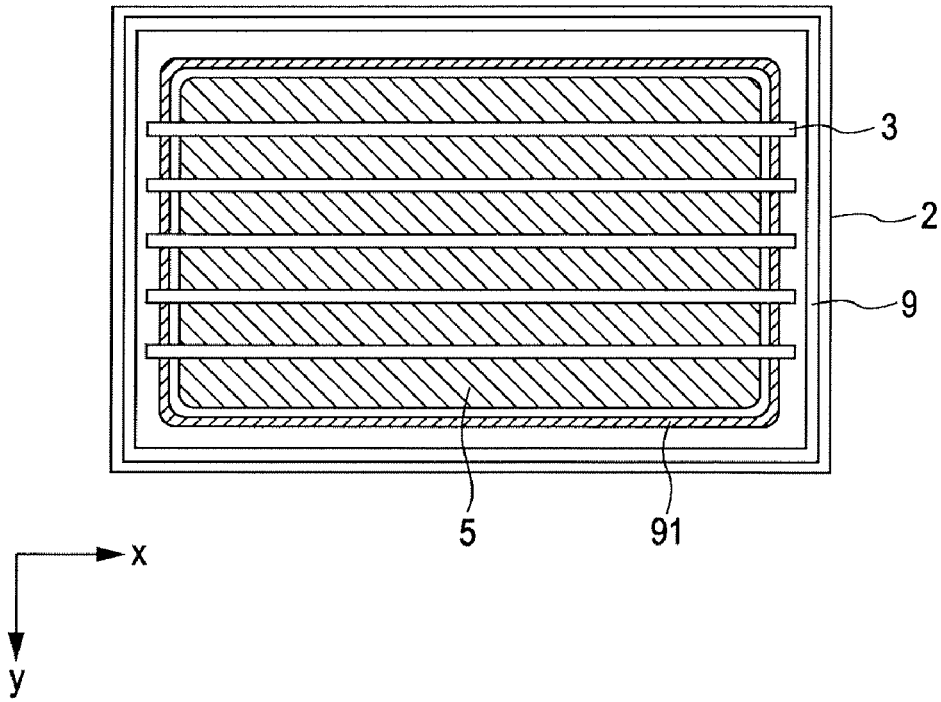
FIG. 14 is a schematic illustration of another image display apparatus according to the embodiment of the present invention.

The faceplate 2 of the image display apparatus according to the third exemplary embodiment is described next with reference to FIG. 14. FIG. 14 is a plan view of the surface of the faceplate 2 of the image display apparatus viewed from the rear plate 1 side when the third potential regulating electrode 91 is used. In FIG. 14, to illustrate the positional relationship between the faceplate 2 and the plate-like spacer 3, the plate-like spacer 3 is shown. The third potential regulating electrode 91 is separated from the anode 5. Additionally, the third potential regulating electrode 91 is disposed so as to enclose the anode 5. The third potential regulating electrode 91 and the anode 5 do not overlap each other. Additionally, the third potential regulating electrode 91 is not directly connected to the anode 5. The anode 5 has the periphery of a substantially rectangular shape. Accordingly, the third potential regulating electrode 91 can be disposed along each side of the substantially rectangular periphery of the anode 5. In general, the third potential regulating electrode 91 is a ring-shaped electroconductive film. The anode 5 is disposed inside the ring-shaped electroconductive film. The length of the plate-like spacer 3 in the longitudinal direction thereof is preferably greater than that of the anode 5 in the longitudinal direction. Additionally, either end of the plate-like spacer 3 in the longitudinal direction is preferably located outside a plane to the anode 5, wherein the plane passes through the end of the first potential regulating electrode 6 adjacent to the anode 5 and whose normal direction is a direction in which the anode 5 faces the first potential regulating electrode 6. Thus, an electric field concentrated on the corner of the plate-like spacer 3 can be reduced, and therefore, the occurrence of electric discharge can be reduced.

The circuit 8 supplies an electric potential to at least part of the anode 5 shown in the plan view of FIG. 14 using a wiring (not shown). Additionally, at that time, the circuit 8 supplies an electric potential to at least part of the third potential regulating electrode 91 shown in the plan view of FIG. 14 using a wiring (not shown).

In a practical point of view, the distance between the anode 5 and the third potential regulating electrode 91 is greater than or equal to 1 mm in order to reduce the electric discharge and is less than or equal to 5 mm in order to reduce the space outside the anode 5. To form the third potential regulating electrode 91, a photolithographic method using a photosensitive material or a screen printing method using a paste containing an electroconductive material can be used.

To form the third potential regulating electrode 91, a metal (such as a silver or a copper), an electroconductive material including metal particles and a low-melting glass, or conductive carbon black can be used for the material of the third potential regulating electrode 91.

In the image display apparatus according to the third exemplary embodiment, the sheet resistance ratio $\rho r/\rho f$ of the plate-like spacer 3 is determined so that $1/100<\rho r/\rho f\leqq 40$. Thus, the electric field intensity applied to the first potential regulating electrode 6 can be decreased. In addition, the electric field concentrated on the end of the anode 5 adjacent to the first potential regulating electrode 6 can be decreased, and therefore, the occurrence of electric discharge can be reduced.

According to the third exemplary embodiment, the electric field concentrated on the first potential regulating electrode 6 and the third potential regulating electrode 91 can be decreased, and therefore, the image display apparatus that can reduce the occurrence of electric discharge can be achieved.

Fourth Exemplary Embodiment

Figure 15:
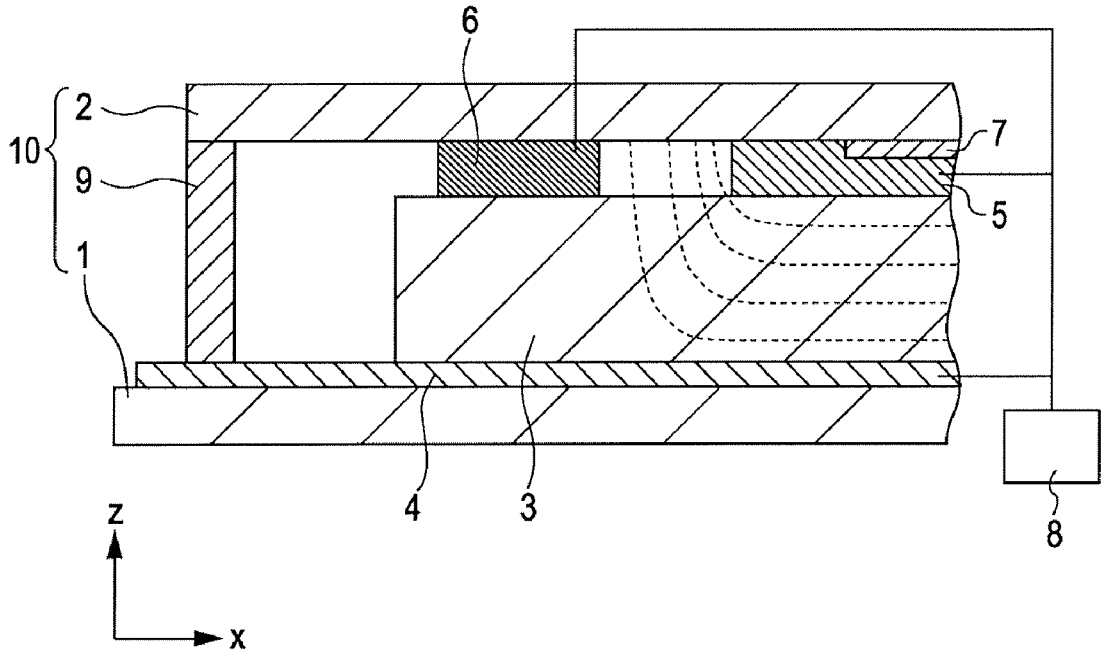
FIG. 15 is a schematic illustration of another image display apparatus according to another embodiment of the present invention.

An image display apparatus according to a fourth exemplary embodiment is described next with reference to FIG. 15. FIG. 15 is a schematic illustration of a cross section of the image display apparatus according to the fourth exemplary embodiment. FIG. 15 corresponds to FIG. 1 of the first exemplary embodiment. A dashed line denotes an equipotential line. The image display apparatus according to the fourth exemplary embodiment has a structure similar to that of the first exemplary embodiment except that the first potential regulating electrode 6 is provided on the faceplate 2 so as to be in contact with the plate-like spacer 3. The difference between the structure of the image display apparatus of the fourth exemplary embodiment and that of the first exemplary embodiment is described below. Similar numbering will be used in describing FIG. 15 as was utilized above in describing FIG. 1.

In the image display apparatus according to the fourth exemplary embodiment, as shown in FIG. 15, the first potential regulating electrode 6 is in contact with the faceplate 2. Accordingly, the electric field concentration on the corner of the plate-like spacer 3 and the structure can be reduced.

According to the fourth embodiment, the faceplate 2 of the image display apparatus can have the structure shown in the plan view of FIG. 14 viewed from the rear plate 1 side. However, in the fourth exemplary embodiment, the third potential regulating electrode 91 shown in FIG. 14 is replaced with the first potential regulating electrode 6.

Subsequently, the sheet resistance ratio $\rho r/\rho f$ of the plate-like spacer 3 is determined so that $1/100<\rho r/\rho f\leqq 40$. Thus, the electric field intensity applied to the first potential regulating electrode 6 can be decreased. In addition, the electric field concentrated on the end of the anode 5 adjacent to the first potential regulating electrode 6 can be decreased, and therefore, the occurrence of electric discharge can be reduced.

When the first potential regulating electrode 6 is fabricated by screen printing, an applied paste may be dragged down by its own weight. Accordingly, after the first potential regulating electrode 6 is fired, the surface of the first potential regulating electrode 6 adjacent to the rear plate 1 may be rounded.

Figure 16:
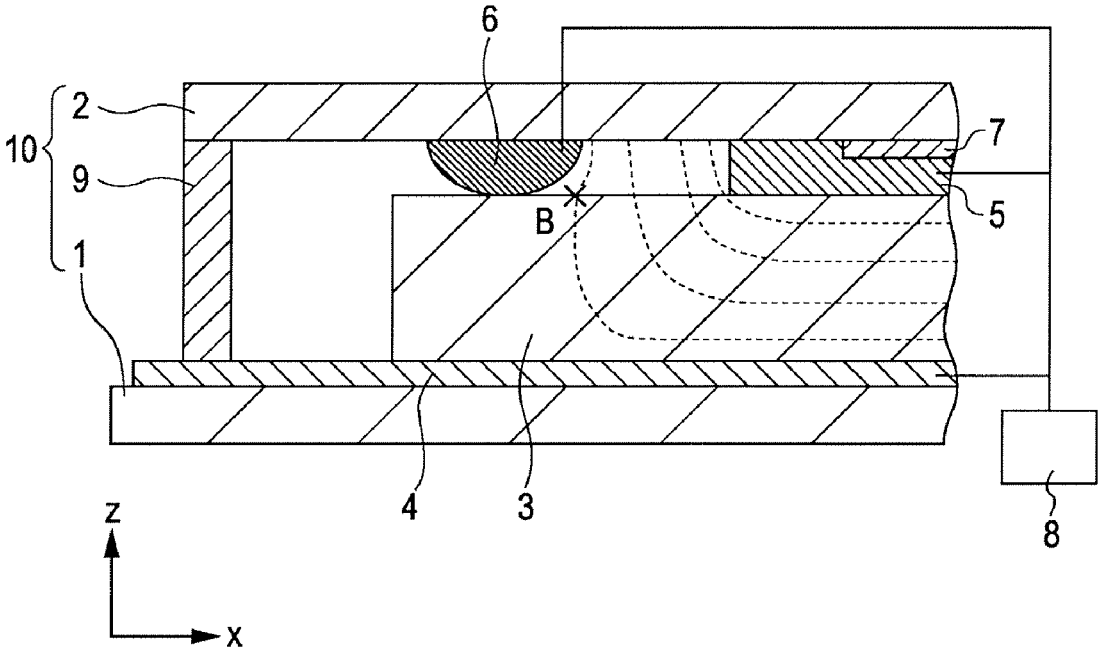
FIG. 16 is a schematic illustration of another image display apparatus according to the embodiment of the present invention.

FIG. 16 is a cross-sectional view of the image display apparatus when the first potential regulating electrode 6 having a rounded surface adjacent to the rear plate 1 is formed. If the surface of the first potential regulating electrode 6 adjacent to the rear plate 1 is rounded, the electric field applied to the end of the first potential regulating electrode 6 adjacent to the anode 5 may become higher than that shown in FIG. 15.

In addition, since the resistance of the first potential regulating electrode 6 is low, the potential over the entire first potential regulating electrode 6 is uniform. However, the potential on the plate-like spacer 3 at a point distant from the second region 22 (e.g., a point B shown in FIG. 16) becomes higher than the potential on the second region 22. Accordingly, the difference in potential between the point distant from the second region 22 and the first potential regulating electrode 6 is generated. Furthermore, if a small gap exists between the point distant from the second region 22 and the first potential regulating electrode 6, a high electric field occurs in the gap, and therefore, electric discharge may occur.

Even in such a case, by setting the sheet resistance ratio $\rho r/\rho f$ of the plate-like spacer 3 so that $1/100<\rho r/\rho f\leqq 40$, the electric field intensity around the second region 22 can be decreased. In addition, since the distance between the equipotential lines around the second region 22 increases in an area between the first region 21 and the second region 22, the intensity of the electric field applied to the end of the first potential regulating electrode 6 adjacent to the anode 5 can be reduced. Furthermore, the electric field concentrated on the end of the anode 5 adjacent to the first potential regulating electrode 6 can be decreased, and therefore, the occurrence of electric discharge can be reduced.

According to the fourth exemplary embodiment, the image display apparatus that can reduce the electric field concentrated on the first potential regulating electrode 6 and the occurrence of electric discharge can be achieved.

In the fourth exemplary embodiment, any material having electrical conductivity can be used for the electrode and the wiring. Accordingly, the electrode may function as the wiring.

While the present invention has been described with reference to an image display apparatus having the envelope 10 including the rear plate 1, the faceplate 2, and the side wall 9, the structure of the image display apparatus is not limited thereto. For example, the envelope 10 may include a dish-shaped rear plate 1 and the faceplate 2 or may include the rear plate 1 and a dish-shaped faceplate 2.

The embodiments described above are merely illustrative in nature and are in no way intended to limit the invention. The components in the exemplary embodiments described above can be replaced with any alternatives and equivalents within the spirit and scope of the invention.

EXAMPLES

The present invention is described in detail below with reference to specific examples.

Example 1

In this example, fifteen image display apparatuses having the structure shown in FIG. 1 were fabricated by changing the sheet resistance ratio $\rho r/\rho f$ of the plate-like spacer 3. These fifteen image display apparatuses are referred to as Samples 1 to 15.

The structure of the image display apparatuses according to EXAMPLE 1 is described below.

(1) The anode 5 and the fluorescent member 7 were formed on the faceplate 2.

A transparent substrate composed of a glass was used as the faceplate 2. A conductive black member having openings in which fluorescent members were disposed was formed on the glass by photolithography. Electroconductive photosensitive carbon black was used as a material of the conductive black member. The thickness of the conductive black member was set to 10 μm. A fluorescent member of an R, G, or B color serving as the fluorescent member 7 was disposed in each of the openings of the conductive black member. Each of the fluorescent members of R, G, and B colors was fabricated in the corresponding opening of the conductive black member so as to have a thickness of 10 μm by screen printing. A 100 nm-thickness Al film was deposited on the entire surfaces of the conductive black member and the fluorescent members by vapor deposition. Thus, the anode 5 including the conductive black member and the Al film was formed.

(2) The plate-like spacer 3 was formed.

In this example, the plate-like spacer 3 having the cross section shown in FIG. 6D was formed. First, WGeN was coated, by sputtering, on the entire surface of an insulating glass, which was a base of the plate-like spacer 3. Subsequently, WGeN was coated on only a region disposed between the first region 21 and the second region 22 by sputtering. Furthermore, WGeN was coated on only a region disposed between the third region 23 and the region disposed between the first region 21 and the second region 22 by sputtering. At that time, by changing the thickness of the WGeN, Samples 1 to 15 having different thicknesses were fabricated.

TABLE 1 shows the result of measurement of the sheet resistances $\rho f$ and $\rho r$ of the plate-like spacer 3 of each of Samples 1 to 15. Note that the fabricated plate-like spacer 3 was 1.6 mm in height (H) and 200 μm in width ($W_{sp}$).

(3) The first potential regulating electrode 6 was formed on the plate-like spacer 3.

Al was deposited on the plate-like spacer 3 at a position separated from the first region 21 and facing the faceplate 2 by sputtering. Thus, the first potential regulating electrode 6 was formed. The first potential regulating electrode 6 was formed so that the distance $L_{12}$ between the first region 21 and the second region 22 is 2 mm. The thickness of the first potential regulating electrode 6 in the z direction was set to 2 μm.

(4) A wiring and an electron emitting device were formed on the rear plate 1.

A glass substrate was prepared for the rear plate 1. One hundred y-direction wirings 51 composed of Ag were formed on the glass substrate with a spacing of 500 μm therebetween by printing. The y-direction wiring 51 is 100 μm in width and 10 μm in thickness. Subsequently, insulating layers (not shown) composed of a silicon oxide and PbO were formed on the intersections between the x-direction wiring 4 and the y-direction wirings 51 by printing. The thickness of the insulating layers was set to 10 μm. Thereafter, three hundred x-direction wirings 4 were formed, by printing, with a spacing of 200 μm therebetween so as to intersect the y-direction wirings 51. The x-direction wiring 4 is 300 μm in width ($W_{xw}$) and 10 μm in thickness. A plurality of the surface-conduction electron emitting devices 52 were formed using a known fabricating method so that any one of the x-direction wirings 4 was connected to any one of the y-direction wirings 51.

(5) The above-described plate-like spacer 3 was disposed on each of the x-direction wirings 4 formed on the rear plate 1.

(6) The side wall 9 was connected to the rear plate 1 and the faceplate 2.

The side wall 9 was disposed between the rear plate 1 and the faceplate 2. The side wall 9 was then bonded to the rear plate 1 by an adhesive agent and the side wall 9 was bonded to the faceplate 2 by an adhesive agent. Thus, the image display apparatus shown in FIG. 1 was formed. Note that the side wall 9 was bonded to the rear plate 1 and the faceplate 2 in a vacuum atmosphere.

Subsequently, the evaluation of electric discharge in the image display apparatus fabricated in this way was performed as follows.

The x-direction wiring 4, the y-direction wiring 51, and the first potential regulating electrode 6 were set to the GND potential. A gradually increasing anode potential was applied to the anode 5. At that time, an electrical current flowing between the anode 5 and the first potential regulating electrode 6 and an electrical current flowing between the anode 5 and the x-direction wiring 4 were measured. The anode potential was increased in steps of 1 kV. When the sum of the electrical current flowing between the anode 5 and the first potential regulating electrode 6 and the electrical current flowing between the anode 5 and the x-direction wiring 4 reaches a value greater than or equal to 1 mA, the value of the anode potential was recorded. This anode potential was considered to be a potential when electrical discharge occurred.

TABLE 1 shows the anode potentials measured using the above-described method when electrical discharge occurs.

In this example, Samples 3 to 7 reduce the occurrence of electric discharge more than Samples 1, 2, 8, and 9. Additionally, Samples 10 to 15 can reduce the occurrence of electric discharge. That is, when the sheet resistance ratio ρr/ρf of the plate-like spacer 3 is set to be $1/100<\rho r/\rho f\leqq 40$, the occurrence of electrical discharge can be reduced. When the sheet resistance ratio ρr/ρf of the plate-like spacer 3 is set to be $1<\rho r/\rho f\leqq 40$, the occurrence of electrical discharge can be further reduced. Furthermore, by setting the sheet resistance ratio ρr/ρf of the plate-like spacer 3 so that $3\leqq\rho r/\rho f\leqq 10$, the occurrence of electrical discharge can be efficiently reduced, and therefore, an excellent image can be displayed without distortion at the edge thereof.

In addition, the withstand voltage of the sample that can reduce the occurrence of electrical discharge satisfies the condition: the anode potential (Va)≧10 kV, which is required for obtaining useful luminance of field emission displays.

Additionally, when the sheet resistances ρf and ρr of the plate-like spacer 3 are greater than or equal to $1.0\times10^{7}$ [Ω/□] and less than or equal to $1.0\times10^{14}$ [Ω/□] and the sheet resistance ratio ρr/ρf is kept constant, the anode potentials when electrical discharge occurs are substantially the same.

In addition, samples were fabricated in which the sheet resistance ratio ρr/ρf of the plate-like spacer 3 was the same as those of Samples 3 to 7 and Samples 10 to 15 and at least one of the sheet resistances ρf and ρr of the plate-like spacer 3 was less than $1.0\times10^{7}$ [Ω/□]. When an image is displayed on these samples, power consumption is increased compared with Samples 3 to 7 and Samples 10 to 15. Furthermore, samples were fabricated in which the sheet resistance ratio ρr/ρf of the plate-like spacer 3 was the same as those of Samples 3 to 7 and Samples 10 to 15 and at least one of the sheet resistances ρf and ρr of the plate-like spacer 3 was greater than $1.0\times10^{14}$ [Ω/□]. When electric discharge of these samples is evaluated while applying the same anode potential, electric discharge occurs in a short time compared with Samples 3 to 7 and Samples 10 to 15.

TABLE 1

| | sheet resistance ρf [Ω/□] | sheet resistance ρr [Ω/□] | sheet resistance ratio ρr/ρf | anode potential when electric discharge occurs [kV] |
|---|---|---|---|---|
| SAMPLE 1 | $1.0\times10^{11}$ | $1.0\times10^{7}$ | 0.0001 | 9 |
| SAMPLE 2 | $1.0\times10^{11}$ | $1.0\times10^{8}$ | 0.001 | 9 |
| SAMPLE 3 | $1.0\times10^{11}$ | $1.0\times10^{9}$ | 0.01 | 10 |
| SAMPLE 4 | $1.0\times10^{11}$ | $1.0\times10^{10}$ | 1 | 13 |
| SAMPLE 5 | $1.0\times10^{11}$ | $3.0\times10^{11}$ | 3 | 16 |
| SAMPLE 6 | $1.0\times10^{11}$ | $1.0\times10^{12}$ | 10 | 17 |
| SAMPLE 7 | $1.0\times10^{11}$ | $4.0\times10^{12}$ | 40 | 15 |
| SAMPLE 8 | $1.0\times10^{11}$ | $5.0\times10^{12}$ | 50 | 9 |
| SAMPLE 9 | $1.0\times10^{11}$ | $1.0\times10^{14}$ | 1000 | 7 |
| SAMPLE 10 | $1.0\times10^{7}$ | $1.0\times10^{7}$ | 1 | 13 |
| SAMPLE 11 | $1.0\times10^{7}$ | $1.0\times10^{7}$ | 3 | 16 |

TABLE 1-continued

| | sheet resistance ρf [Ω/□] | sheet resistance ρr [Ω/□] | sheet resistance ratio ρr/ρf | anode potential when electric discharge occurs [kV] |
|---|---|---|---|---|
| SAMPLE 12 | $1.0\times10^{7}$ | $1.0\times10^{7}$ | 10 | 17 |
| SAMPLE 13 | $1.0\times10^{7}$ | $4.0\times10^{8}$ | 40 | 15 |
| SAMPLE 14 | $1.0\times10^{14}$ | $1.0\times10^{12}$ | 0.01 | 10 |
| SAMPLE 15 | $1.0\times10^{14}$ | $1.0\times10^{14}$ | 1 | 13 |

Example 2

In this example, seven image display apparatuses having the structure shown in FIG. 11 were fabricated by changing the sheet resistance ratio ρr/ρf of the plate-like spacer 3. These image display apparatuses are referred to as Samples 1 to 7.

The primary structures of the image display apparatuses in this example are similar to those of Example 1. Accordingly, only differences between Example 2 and Example 1 are described.

In this example, the length of the third region 81 in the x direction was set to 2 mm and the length of the third region 81 in the y direction was set to 200 mm.

Subsequently, like Example 1, electric discharge of the image display apparatuses in this example was evaluated. The anode potentials when electric discharge occurred are shown in Table 2.

In this example, Samples 2 to 6 can reduce the occurrence of electric discharge more than Samples 1 and 7. That is, when the sheet resistance ratio ρr/ρf of the plate-like spacer 3 is set to be $1/100<\rho r/\rho f\leqq 40$, the occurrence of electrical discharge can be reduced. When the sheet resistance ratio ρr/ρf of the plate-like spacer 3 is set to be $1<\rho r/\rho f\leqq 40$, the occurrence of electrical discharge can be further reduced.

Like Example 1, when the sheet resistances ρf and ρr of the plate-like spacer 3 are greater than or equal to $1.0\times10^{7}$ [Ω/□] and less than or equal to $1.0\times10^{14}$ [Ω/□] and the sheet resistance ratio ρr/ρf is kept constant, the anode potentials when electrical discharge occurs are substantially the same. Furthermore, by setting the sheet resistance ratio ρr/ρf of the plate-like spacer 3 to a value more than or equal to 3 and less than or equal to 10, the occurrence of electrical discharge can be efficiently reduced, and therefore, an excellent image can be displayed without distortion at the edge thereof.

In addition, samples were fabricated in which the sheet resistance ratio ρr/ρf of the plate-like spacer 3 is the same as those of Samples 2 to 6 and at least one of the sheet resistances ρf and ρr of the plate-like spacer 3 is less than $1.0\times10^{7}$ [Ω/□]. When an image is displayed on these samples, power consumption is increased compared with Samples 2 to 6. Furthermore, samples were fabricated in which the sheet resistance ratio ρr/ρf of the plate-like spacer 3 is the same as those of Samples 2 to 6 and at least one of the sheet resistances ρf and ρr of the plate-like spacer 3 is greater than $1.0\times10^{14}$ [Ω/□]. When electric discharge of these samples is evaluated while applying the same anode potential, electric discharge occurs in a short time compared with Samples 2 to 6.

TABLE 2

| | sheet resistance ρf [Ω/□] | sheet resistance ρr [Ω/□] | sheet resistance ratio ρr/ρf | anode potential when electric discharge occurs [kV] |
|---|---|---|---|---|
| SAMPLE 1 | $1.0 \times 10^{10}$ | $9.0 \times 10^{7}$ | 0.001 | 9 |
| SAMPLE 2 | $1.0 \times 10^{10}$ | $1.0 \times 10^{8}$ | 0.01 | 10 |
| SAMPLE 3 | $1.0 \times 10^{10}$ | $1.0 \times 10^{10}$ | 1 | 13 |
| SAMPLE 4 | $1.0 \times 10^{10}$ | $3.0 \times 10^{10}$ | 3 | 16 |
| SAMPLE 5 | $1.0 \times 10^{10}$ | $1.0 \times 10^{11}$ | 10 | 17 |
| SAMPLE 6 | $1.0 \times 10^{10}$ | $4.0 \times 10^{11}$ | 40 | 15 |
| SAMPLE 7 | $1.0 \times 10^{10}$ | $5.0 \times 10^{11}$ | 50 | 9 |

Example 3

In this example, seven image display apparatuses having the structure shown in FIG. 13 were fabricated by changing the sheet resistance ratio ρr/ρf of the plate-like spacer 3. These image display apparatuses are referred to as Samples 1 to 7.

The primary structures of the image display apparatuses in this example are similar to those of Example 1. Accordingly, only differences between Example 3 and Example 1 are described.

In this example, the third potential regulating electrode 91 was formed on the faceplate 2 at a position separated from the anode 5 and facing the first potential regulating electrode 6.

The third potential regulating electrode 91 was formed on the faceplate 2 using carbon black. The distance between the third potential regulating electrode 91 and the anode 5 was set to 2 mm. The thickness of the third potential regulating electrode 91 in the z direction was set to 5 μm. The width of a region of the third potential regulating electrode 91 over which the plate-like spacer 3 extended in the x direction was set to 500 μm.

Subsequently, like Example 1, electric discharge of the image display apparatuses in this example was evaluated. However, the third potential regulating electrode 91 was set to the GND potential. Electric currents flowing between the first potential regulating electrode 6 and the anode 5 and between the third potential regulating electrode 91 and the anode 5 were measured rather than measuring an electrical current flowing between the first potential regulating electrode 6 and the anode 5. The anode potentials when electric discharge occurred are shown in Table 3.

In this example, Samples 2 to 6 reduce the occurrence of electric discharge more than Samples 1 and 7. That is, when the sheet resistance ratio ρr/ρf of the plate-like spacer 3 is set to be $1/100<\rho r/\rho f\leqq 40$, the occurrence of electric discharge can be reduced. When the sheet resistance ratio ρr/ρf of the plate-like spacer 3 is set to be $1<\rho r/\rho f\leqq 40$, the occurrence of electrical discharge can be further reduced.

Additionally, like Example 1, when the sheet resistances ρf and ρr of the plate-like spacer 3 are greater than or equal to $1.0\times10^{7}$ [Ω/□] and less than or equal to $1.0\times10^{14}$ [Ω/□] and the sheet resistance ratio ρr/ρf is kept constant, the anode potentials when electrical discharge occurs are substantially the same. Furthermore, by setting the sheet resistance ratio ρr/ρf of the plate-like spacer 3 to a value more than or equal to 3 and less than or equal to 10, the occurrence of electrical discharge can be efficiently reduced, and therefore, an excellent image can be displayed without distortion at the edge thereof.

In addition, samples were fabricated in which the sheet resistance ratio ρr/ρf of the plate-like spacer 3 was the same as those of Samples 2 to 6 and at least one of the sheet resistances ρf and ρr of the plate-like spacer 3 was less than $1.0\times10^{7}$ [Ω/□]. When an image is displayed on these samples, power consumption is increased compared with Samples 2 to 6. Furthermore, samples were fabricated in which the sheet resistance ratio ρr/ρf of the plate-like spacer 3 was the same as those of Samples 2 to 6 and at least one of the sheet resistances ρf and ρr of the plate-like spacer 3 was greater than $1.0\times10^{14}$ [Ω/□]. When electric discharge of these samples is evaluated while applying the same anode potential, electric discharge occurs in a short time compared with Samples 2 to 6.

TABLE 3

| | sheet resistance ρf [Ω/□] | sheet resistance ρr [Ω/□] | sheet resistance ratio ρr/ρf | anode potential when electric discharge occurs [kV] |
|---|---|---|---|---|
| SAMPLE 1 | $1.0 \times 10^{10}$ | $9.0 \times 10^{7}$ | 0.001 | 9 |
| SAMPLE 2 | $1.0 \times 10^{10}$ | $1.0 \times 10^{8}$ | 0.01 | 10 |
| SAMPLE 3 | $1.0 \times 10^{10}$ | $1.0 \times 10^{10}$ | 1 | 14 |
| SAMPLE 4 | $1.0 \times 10^{10}$ | $3.0 \times 10^{10}$ | 3 | 18 |
| SAMPLE 5 | $1.0 \times 10^{10}$ | $1.0 \times 10^{11}$ | 10 | 19 |
| SAMPLE 6 | $1.0 \times 10^{10}$ | $4.0 \times 10^{11}$ | 40 | 17 |
| SAMPLE 7 | $1.0 \times 10^{10}$ | $5.0 \times 10^{11}$ | 50 | 11 |

Example 4

In this example, seven image display apparatuses having the structure shown in FIG. 15 were fabricated by changing the sheet resistance ratio ρr/ρf of the plate-like spacer 3. These image display apparatuses are referred to as Samples 1 to 7.

The structures of the image display apparatuses in this example are similar to those of Example 1 except that the first potential regulating electrode 6 was disposed so as to be in contact with the faceplate 2. Accordingly, only differences between Example 4 and Example 1 are described.

In this example, the first potential regulating electrode 6 was formed so as to be in contact with the faceplate 2.

The first potential regulating electrode 6 was formed on the faceplate 2 using carbon black. The distance between the first region 21 and the second region 22 was set to 2 mm. The thickness of the first potential regulating electrode 6 in the z direction was set to 10.1 μm. After the withstand voltage had been evaluated, the faceplate 2 was removed and checked. At that time, it was found that a region of the surface of the faceplate 2 adjacent to the rear plate 1 at a position at which the faceplate 2 was in contact with the first potential regulating electrode 6 slightly caved in. Thus, it is confirmed that the surface of the faceplate 2 adjacent to the rear plate 1 is in contact with the first potential regulating electrode 6.

Subsequently, like Example 1, electric discharge of the image display apparatuses in this example was evaluated. The evaluation was performed as in Example 1. The anode potentials when electric discharge occurred are shown in Table 4.

In this example, Samples 2 to 6 can reduce the occurrence of electric discharge more than Samples 1 and 7. That is, when the sheet resistance ratio ρr/ρf of the plate-like spacer 3 is set to be $1/100<\rho r/\rho f\leqq 40$, the occurrence of electrical discharge can be reduced. When the sheet resistance ratio ρr/ρf of the plate-like spacer 3 is set to be $1<\rho r/\rho f\leqq 40$, the occurrence of electrical discharge can be reduced. Furthermore, by setting the sheet resistance ratio $\rho r/\rho f$ of the plate-like spacer 3 so that $3\leqq\rho r/\rho f\leqq 10$, the occurrence of electrical discharge can be efficiently reduced, and therefore, an excellent image can be displayed without distortion at the edge thereof.

Additionally, like Example 1, when the sheet resistances $\rho f$ and $\rho r$ of the plate-like spacer 3 are greater than or equal to $1.0\times10^{7}$ [Ω/□] and less than or equal to $1.0\times10^{14}$ [Ω/□] and the sheet resistance ratio $\rho r/\rho f$ is kept constant, the anode potentials when electrical discharge occurs are substantially the same.

In addition, samples were fabricated in which the sheet resistance ratio $\rho r/\rho f$ of the plate-like spacer 3 was the same as those of Samples 2 to 6 and at least one of the sheet resistances $\rho f$ and $\rho r$ of the plate-like spacer 3 was less than $1.0\times10^{7}$ [Ω/□]. When an image is displayed on these samples, power consumption is increased compared with Samples 2 to 6. Furthermore, samples were fabricated in which the sheet resistance ratio $\rho r/\rho f$ of the plate-like spacer 3 was the same as those of Samples 2 to 6 and at least one of the sheet resistances $\rho f$ and $\rho r$ of the plate-like spacer 3 was greater than $1.0\times10^{14}$ [Ω/□]. When electric discharge of these samples is evaluated while applying the same anode potential, electric discharge occurs in a short time compared with Samples 2 to 6.

TABLE 4

| | sheet resistance ρf [Ω/□] | sheet resistance ρr [Ω/□] | sheet resistance ratio ρr/ρf | anode potential when electric discharge occurs [kV] |
|---|---|---|---|---|
| SAMPLE 1 | $1.0\times10^{12}$ | $1.0\times10^{10}$ | 0.001 | 10 |
| SAMPLE 2 | $1.0\times10^{12}$ | $1.0\times10^{11}$ | 0.01 | 11 |
| SAMPLE 3 | $1.0\times10^{12}$ | $1.0\times10^{12}$ | 1 | 15 |
| SAMPLE 4 | $1.0\times10^{12}$ | $3.0\times10^{12}$ | 3 | 19 |
| SAMPLE 5 | $1.0\times10^{12}$ | $1.0\times10^{13}$ | 10 | 20 |
| SAMPLE 6 | $1.0\times10^{12}$ | $4.0\times10^{13}$ | 40 | 18 |
| SAMPLE 7 | $1.0\times10^{12}$ | $5.0\times10^{13}$ | 50 | 11 |

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2006-008812 filed Jan. 17, 2006, which is hereby incorporated by reference herein in its entirety.

What is claimed is:

1. An image display apparatus comprising:

an envelope;

a first electroconductive member, a second electroconductive member, and a third electroconductive member disposed in the envelope;

a spacer disposed between the first electroconductive member and the third electroconductive member and between the second electroconductive member and the third electroconductive member;

a circuit for supplying a first electric potential to the first electroconductive member and supplying a second electric potential that is lower than the first electric potential to the second electroconductive member and the third electroconductive member, wherein, when a first sheet resistance between a first region of the spacer to which the first electric potential is supplied from the first electroconductive member and a second region of the spacer to which the electric potential is supplied from the second electroconductive member is defined as $\rho f$ [Ω/□], and a second sheet resistance between a third region of the spacer to which the electric potential is supplied from the third electroconductive member and a region located between the first region and the second region is defined as $\rho r$ [Ω/□], a condition $1/100<\rho r/\rho f\leqq 40$ is satisfied; and a luminescent member disposed in the envelope.

2. The image display apparatus according to claim 1, further comprising:

a fourth electroconductive member disposed between the envelope and the second electroconductive member, wherein the circuit further supplies the fourth electroconductive member with a third electric potential that is lower than the first electric potential applied to the first electroconductive member.

3. The image display apparatus according to claim 1, wherein the second electroconductive member is in contact with the envelope.

4. The image display apparatus according to claim 3, wherein the second electroconductive member is disposed so as to surround the first electroconductive member with a space therebetween, and a length of the spacer in a longitudinal direction is greater than a length of the first electroconductive member in the longitudinal direction, and wherein either end of the spacer in the longitudinal direction is located outside a plane of the first electroconductive member, wherein the plane passes through an end of the second electroconductive member adjacent to the first electroconductive member and whose normal direction is a direction in which the first electroconductive member faces the second electroconductive member.

5. The image display apparatus according to claim 1, wherein the third electroconductive member includes a wiring for supplying the electric potential to an electron emitting device disposed in the envelope.

6. The image display apparatus according to claim 1, wherein, when a plane that passes through an end of the first electroconductive member adjacent to the second electroconductive member and whose normal direction is a direction in which the first electroconductive member faces the second electroconductive member is defined as a first plane, and a plane that passes through an end of the second electroconductive member adjacent to the first electroconductive member and whose normal direction is the direction in which the first electroconductive member faces the second electroconductive member is defined as a second plane, at least part of the third region is located between the first plane and the second plane and wherein the first plane and the second plane pass through the third region.

7. The image display apparatus according to claim 1, wherein a distance between the first region and the second region is greater than or equal to 1 mm and less than or equal to 5 mm, and wherein a length of the spacer in the longitudinal direction is greater than or equal to 0.5 mm and less than or equal to 5 mm.

8. The image display apparatus according to claim 1, wherein the sheet resistance $\rho f$ is greater than or equal to $1.0\times10^{7}$ [Ω/□] and less than or equal to $1.0\times10^{14}$ [Ω/□].

9. The image display apparatus according to claim 1, wherein the sheet resistance $\rho r$ is greater than or equal to $1.0\times10^{7}$ [Ω/□] and less than or equal to $1.0\times10^{14}$ [Ω/□].

10. The image display apparatus according to claim 1, wherein the first electroconductive member is disposed so as to cover the luminescent member.

11. The image display apparatus according to claim 1, wherein the first electroconductive member has an opening and the luminescent member is disposed in the opening.

12. The image display apparatus according to claim 1, wherein a condition $3 \leqq \rho r/\rho f \leqq 10$ is satisfied.

13. A video signal receiving and display apparatus comprising:

an envelope;

a first electroconductive member, a second electroconductive member, and a third electroconductive member disposed in the envelope;

a spacer disposed between the first electroconductive member and the third electroconductive member and between the second electroconductive member and the third electroconductive member;

a circuit for supplying a first electric potential to the first electroconductive member and supplying a second electric potential that is lower than the first electric potential to the second electroconductive member and the third electroconductive member, wherein, when a first sheet resistance between a first region of the spacer to which the first electric potential is supplied from the first electroconductive member and a second region of the spacer to which the electric potential is supplied from the second electroconductive member is defined as $\rho f$ [Ω/□], and a second sheet resistance between a third region of the spacer to which the electric potential is supplied from the third electroconductive member and a region located between the first region and the second region is defined as $\rho r$ [Ω/□], a condition $1/100 < \rho r/\rho f \leqq 40$ is satisfied;

a luminescent member disposed in the envelope;

a receiving circuit configured to select and receive a video signal; and an output circuit configured to generate an image signal output to the image display apparatus on the basis of the video signal received by the receiving circuit.

14. The video signal receiving and display apparatus according to claim 13, further comprising:

a fourth electroconductive member disposed between the envelope and the second electroconductive member, wherein the circuit further supplies the fourth electroconductive member with a third electric potential that is lower than the first electric potential applied to the first electroconductive member.

15. The video signal receiving and display apparatus according to claim 13, wherein the second electroconductive member is in contact with the envelope.

16. The video signal receiving and display apparatus according to claim 15, wherein the second electroconductive member is disposed so as to surround the first electroconductive member with a space therebetween, and a length of the spacer in a longitudinal direction is greater than a length of the first electroconductive member in the longitudinal direction, and wherein either end of the spacer in the longitudinal direction is located outside a plane of the first electroconductive member, wherein the plane passes through an end of the second electroconductive member adjacent to the first electroconductive member and whose normal direction is a direction in which the first electroconductive member faces the second electroconductive member.

17. The video signal receiving and display apparatus according to claim 13, wherein the third electroconductive member includes a wiring for supplying the electric potential to an electron emitting device disposed in the envelope.

18. The video signal receiving and display apparatus according to claim 13, wherein, when a plane that passes through an end of the first electroconductive member adjacent to the second electroconductive member and whose normal direction is a direction in which the first electroconductive member faces the second electroconductive member is defined as a first plane, and a plane that passes through an end of the second electroconductive member adjacent to the first electroconductive member and whose normal direction is the direction in which the first electroconductive member faces the second electroconductive member is defined as a second plane, at least part of the third region is located between the first plane and the second plane and wherein the first plane and the second plane pass through the third region.

19. The video signal receiving and display apparatus according to claim 13, wherein a distance between the first region and the second region is greater than or equal to 1 mm and less than or equal to 5 mm, and wherein a length of the spacer in the longitudinal direction is greater than or equal to 0.5 mm and less than or equal to 5 mm.

20. The video signal receiving and display apparatus according to claim 13, wherein the sheet resistance $\rho f$ is greater than or equal to $1.0 \times 10^7$ [Ω/□] and less than or equal to $1.0 \times 10^{14}$ [Ω/□].

21. The video signal receiving and display apparatus according to claim 13, wherein the sheet resistance $\rho r$ is greater than or equal to $1.0 \times 10^7$ [Ω/□] and less than or equal to $1.0 \times 10^{14}$ [Ω/□].

22. The video signal receiving and display apparatus according to claim 13, wherein a condition $3 \leqq \rho r/\rho f \leqq 10$ is satisfied.

* * * * *